US012172780B2

(12) United States Patent
Ford et al.

(10) Patent No.: US 12,172,780 B2
(45) Date of Patent: Dec. 24, 2024

(54) METHOD AND SYSTEM FOR ATTACHING ARTICLES TO A CARRIER

(71) Applicant: Graphic Packaging International, LLC, Atlanta, GA (US)

(72) Inventors: Colin P. Ford, Woodstock, GA (US); Cory Hawley, Austell, GA (US); David F. Warner, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 216 days.

(21) Appl. No.: 17/239,947

(22) Filed: Apr. 26, 2021

(65) Prior Publication Data

US 2021/0331819 A1 Oct. 28, 2021

Related U.S. Application Data

(60) Provisional application No. 63/016,607, filed on Apr. 28, 2020.

(51) Int. Cl.

| | |
|---|---|
| ***B65B 35/30*** | (2006.01) |
| ***B65B 17/02*** | (2006.01) |
| ***B65D 71/44*** | (2006.01) |

(52) U.S. Cl.

CPC ..... *B65B 17/025* (2013.01); *B65B 35/30* (2013.01); *B65D 71/44* (2013.01)

(58) Field of Classification Search

USPC ..... 53/398

See application file for complete search history.

(56) References Cited

U.S. PATENT DOCUMENTS

| | | | |
|---|---|---|---|
| 1,527,399 | A | 2/1925 | Davidson |
| 2,289,859 | A | 7/1942 | Arthur |

(Continued)

FOREIGN PATENT DOCUMENTS

| | | |
|---|---|---|
| AT | 399701 B | 7/1995 |
| CA | 2133827 | 10/1993 |

(Continued)

OTHER PUBLICATIONS

International Search Report and Written Opinion for PCT/US2021/029069 dated Aug. 2, 2021.

(Continued)

*Primary Examiner* — Chinyere J Rushing-Tucker

(74) *Attorney, Agent, or Firm* — Womble Bond Dickinson (US) LLP

(57) ABSTRACT

A method of at least partially forming packages. The method comprises moving a blank and a plurality of articles in a downstream direction through a clipping station. The blank can comprise at least a first attachment panel, a second attachment panel, and a keel portion extending from the first attachment panel to the second attachment panel. The method further can comprise forming a clipped assembly by clipping the first attachment panel and the second attachment panel of the blank to respective articles of the plurality of articles during the moving the blank and the plurality of articles through the clipping station and forming a keel by moving articles of the plurality of articles toward one another and folding the keel portion of the blank between the articles as the clipped assembly is moved in the downstream direction.

20 Claims, 15 Drawing Sheets

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,950,041 A 8/1960 Stone
2,965,410 A 12/1960 Hughes
3,001,647 A 9/1961 Liss
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
3,200,944 A 8/1965 Rapata
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,528,697 A 9/1970 Wood
3,587,847 A 6/1971 Graser
3,601,439 A 8/1971 Poupitch
3,612,266 A 10/1971 Graser
D222,579 S 11/1971 Oglesbee
3,627,121 A 12/1971 Deasy
3,653,503 A * 4/1972 Arneson ..... B65B 35/44
294/87.2
3,693,787 A 9/1972 Duerr
3,698,550 A 10/1972 Graser
3,701,416 A 10/1972 Lawrence
3,722,945 A 3/1973 Wood
3,726,558 A 4/1973 Klygis
3,734,278 A 5/1973 Kerrigan
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,050,579 A 9/1977 Gorski et al.
4,078,357 A 3/1978 Ida
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
D257,001 S 9/1980 Oliff
4,244,617 A 1/1981 Manizza
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,523,676 A 6/1985 Barrash
D294,331 S 2/1988 Panazzolo
4,784,266 A 11/1988 Chaussadas
D304,017 S 10/1989 Oliff
4,911,288 A 3/1990 Dantoin, Jr.
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
D329,807 S 9/1992 Heider
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,359,830 A * 11/1994 Olson ..... B65B 17/025
53/134.1
5,360,104 A 11/1994 Sutherland
5,390,784 A 2/1995 Sutherland
5,407,065 A 4/1995 Sutherland
5,415,278 A 5/1995 Sutherland
5,425,446 A 6/1995 Weaver
5,443,153 A 8/1995 Sutherland
5,445,262 A 8/1995 Sutherland
5,452,799 A 9/1995 Sutherland
5,469,687 A 11/1995 Olson
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,551,566 A 9/1996 Sutherland
5,553,704 A 9/1996 Gordon et al.
5,553,705 A 9/1996 Bakx
5,573,111 A 11/1996 Gordon
5,590,776 A 1/1997 Galbierz
5,593,027 A 1/1997 Sutherland
5,609,247 A 3/1997 Appleton
5,609,251 A 3/1997 Harris
5,609,379 A 3/1997 Harrelson
5,639,137 A 6/1997 Bakx
5,682,982 A 11/1997 Stonehouse
5,706,936 A 1/1998 Bernstein
5,711,419 A 1/1998 Beales et al.
5,735,394 A 4/1998 Harrelson
5,746,310 A 5/1998 Slomski
5,762,193 A 6/1998 Marco
5,791,463 A 8/1998 Negelen
5,816,391 A 10/1998 Harris
5,845,776 A 12/1998 Galbierz et al.
5,878,876 A 3/1999 Galbierz et al.
5,960,945 A 10/1999 Sutherland
6,039,181 A 3/2000 Whiteside
6,059,099 A 5/2000 Galbierz
6,082,532 A 7/2000 Miess
6,145,656 A 11/2000 Marco
6,293,392 B1 9/2001 Galbierz
6,315,111 B1 11/2001 Sutherland
6,394,272 B1 5/2002 Domansky
6,896,130 B2 5/2005 Theelen
D506,925 S 7/2005 Plumer
7,011,209 B2 3/2006 Sutherland et al.
7,690,507 B2 4/2010 Sutherland
7,721,878 B2 5/2010 Requena

(56) References Cited

U.S. PATENT DOCUMENTS

| | | | |
|---|---|---|---|
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 8,056,709 | B2 | 11/2011 | Sutherland |
| 8,096,413 | B2 | 1/2012 | Coltri DePaula |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |
| 8,955,674 | B2 | 2/2015 | Spivey, Sr. et al. |
| 9,079,699 | B2 | 7/2015 | Holley, Jr. |
| 9,169,050 | B2 | 10/2015 | Spivey, Sr. |
| 9,284,090 | B2 | 3/2016 | Lettre |
| 9,359,093 | B2 | 6/2016 | DePaula et al. |
| 9,376,250 | B2 | 6/2016 | Spivey, Sr. |
| D767,408 | S | 9/2016 | Shuster |
| 9,446,891 | B2 | 9/2016 | Jones et al. |
| 9,511,916 | B2 | 12/2016 | Holley, Jr. |
| 9,669,976 | B2 | 6/2017 | Kastanek et al. |
| 9,676,535 | B2 | 6/2017 | Spivey, Sr |
| 10,077,131 | B2 | 9/2018 | Lettre |
| D881,021 | S | 4/2020 | Bandinu |
| D881,718 | S | 4/2020 | Bandinu |
| 10,836,550 | B2 | 11/2020 | Zacherle |
| D918,057 | S | 5/2021 | L'Heureux |
| D918,058 | S | 5/2021 | L'Heureux |
| 11,014,727 | B2 | 5/2021 | McCree |
| D920,809 | S | 6/2021 | Chesnet et al. |
| D921,493 | S | 6/2021 | Chesnet |
| D923,416 | S | 6/2021 | Luciano |
| 11,027,905 | B2 | 6/2021 | Ford |
| 11,180,301 | B2 | 11/2021 | Smalley |
| D944,656 | S | 3/2022 | Spivey, Sr. |
| D946,416 | S | 3/2022 | Smalley |
| D946,417 | S | 3/2022 | Gonzalez Manzano |
| D946,418 | S | 3/2022 | Gonzalez Manzano |
| D946,419 | S | 3/2022 | Gonzalez Manzano |
| D946,420 | S | 3/2022 | Gonzalez Manzano |
| D946,421 | S | 3/2022 | Gonzalez Manzano |
| 11,261,013 | B2 | 3/2022 | Smalley |
| 11,286,094 | B2 | 3/2022 | Gonzalez Manzano |
| D955,889 | S | 6/2022 | Gonzalez Manzano |
| D955,890 | S | 6/2022 | Gonzalez Manzano |
| D956,574 | S | 7/2022 | Gonzalez Manzano |
| 11,401,095 | B2 | 8/2022 | Rosenbrien |
| 11,420,802 | B2 | 8/2022 | Kooc |
| D962,789 | S | 9/2022 | Noel |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0206639 | A1 | 10/2004 | Karlsson |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2006/0255114 | A1 | 11/2006 | Hand et al. |
| 2007/0080084 | A1 | 4/2007 | Sutherland |
| 2007/0163908 | A1 | 7/2007 | Sutherland |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2011/0000799 | A1 | 1/2011 | Gonzalez |
| 2011/0030311 | A1 | 2/2011 | Martini |
| 2012/0138489 | A1 | 6/2012 | Holley, Jr. |
| 2015/0191287 | A1 | 7/2015 | L'Heureux et al. |
| 2016/0325899 | A1 | 11/2016 | L'Heureux et al. |
| 2018/0111734 | A1 | 4/2018 | Jego |
| 2018/0222650 | A1 | 8/2018 | Zacherle |
| 2018/0362234 | A1 | 12/2018 | L'Heureux et al. |
| 2019/0119019 | A1 | 4/2019 | Patton |
| 2020/0010255 | A1 | 1/2020 | Zacherle et al. |
| 2020/0079564 | A1 | 3/2020 | Ford |
| 2020/0189817 | A1 | 6/2020 | Smalley |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |
| 2022/0097941 | A1 | 3/2022 | McCree |

FOREIGN PATENT DOCUMENTS

| | | | |
|---|---|---|---|
| DE | 298 13 672 | U1 | 11/1998 |
| DE | 203 19 247 | U1 | 5/2004 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 2 067 713 | A1 | 6/2009 |
| EP | 2 085 314 | A2 | 8/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| FR | 2 737 196 | A1 | 1/1997 |
| GB | 1 256 684 | | 12/1971 |
| GB | 2 321 229 | A | 7/1998 |
| GB | 9006736716 | | 8/2019 |
| GB | 2591535 | A | 8/2021 |
| GB | 6161591 | | 9/2021 |
| JP | 10-297668 | A | 11/1998 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 94/26594 | A1 | 11/1994 |
| WO | WO 95/01289 | A1 | 1/1995 |
| WO | WO 95/06604 | | 3/1995 |
| WO | WO 96/26128 | A1 | 8/1996 |
| WO | WO 96/32340 | A1 | 10/1996 |
| WO | WO 2006/044583 | A2 | 4/2006 |
| WO | WO 2008/058294 | A1 | 5/2008 |
| WO | WO 2010/006629 | A1 | 1/2010 |
| WO | WO 2010/101852 | A1 | 9/2010 |
| WO | WO 2016/100010 | A1 | 6/2016 |
| WO | WO 2016/112145 | A1 | 7/2016 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

"Florida brewery unveils six-pack rings that spare sea turtles, not snare them," by Thomas Leavy, CBSNews.com. Date posted: May 24, 2018. Site visited: Sep. 12, 2022. Available online: https://www.

(56) References Cited

OTHER PUBLICATIONS cbsnews.com/news/ florida-saltwater-brewery-non-plastic-six-pack-rings-spare-sea-turtles/ (Year: 2018).
"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).
Enviroclip. Date posted: 2022. Site visited: Sep. 12, 2022. Available online: https://www.graphicpkg.com/products/enviroclip/ (Year: 2022).
"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).
"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).
Cap-it packaging video on Vimeo. Date posted: 2021. Site visited: Sep. 19, 2022. Available online: https://vimeo.com/610619455?embedded=true&source=vimeo_logo&owner=24551687 (Year: 2021).
2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).
Supplementary European Search Report for EP 21 79 6509 dated May 21, 2024.

* cited by examiner

METHOD AND SYSTEM FOR ATTACHING ARTICLES TO A CARRIER

CROSS-REFERENCE TO RELATED APPLICATIONS

This application claims the benefit of U.S. Provisional Patent Application No. 63/016,607, filed on Apr. 28, 2020.

INCORPORATION BY REFERENCE

The disclosures of each of U.S. Provisional Patent Application No. 63/016,607, filed on Apr. 28, 2020, U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/841,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design patent application Ser. No. 29/692,992, filed on May 30, 2019, U.S. Design patent application Ser. No. 29/692,993, filed on May 30, 2019, U.S. Design patent application Ser. No. 29/692,994, filed on May 30, 2019, U.S. Design patent application Ser. No. 29/692,996, filed on May 30, 2019, U.S. Design patent application Ser. No. 29/692,997, filed on May 30, 2019, U.S. patent application Ser. No. 16/598,282, filed on Oct. 10, 2019, U.S. Design patent application Ser. No. 29/709,918, filed on Oct. 18, 2019, U.S. Provisional Patent Application No. 62/952,839, filed on Dec. 23, 2019, and U.S. Provisional Patent Application No. 62/956,882, filed on Jan. 3, 2020, U.S. patent application Ser. No. 16/829,346, filed on Mar. 25, 2020, are hereby incorporated by reference for all purposes as if presented herein in their entirety.

BACKGROUND OF THE DISCLOSURE

The present disclosure generally relates to packages including carriers attached to articles and to methods of forming the packages. More specifically, the present disclosure is directed to methods and systems for forming the packages by clipping blanks to articles, forming keels from the blanks between the articles, and folding the blanks into carriers, for example.

SUMMARY OF THE DISCLOSURE

In general, one aspect of the disclosure is directed to a method of at least partially forming packages. The method comprises moving a blank and a plurality of articles in a downstream direction through a clipping station. The blank can comprise at least a first attachment panel, a second attachment panel, and a keel portion extending from the first attachment panel to the second attachment panel. The method further can comprise forming a clipped assembly by clipping the first attachment panel and the second attachment panel of the blank to respective articles of the plurality of articles during the moving the blank and the plurality of articles through the clipping station and forming a keel by moving articles of the plurality of articles toward one another and folding the keel portion of the blank between the articles as the clipped assembly is moved in the downstream direction.

In another aspect, the disclosure is generally directed to a system for at least partially forming packages. The system can comprise a clipping station that receives a plurality of articles and a blank comprising at least a first attachment panel, a second attachment panel, and a keel portion extending from the first attachment panel to the second attachment panel. The clipping station can clip the first attachment panel and the second attachment panel of the blank to respective articles of the plurality of articles to form a clipped assembly while moving the blank and the plurality of articles in a downstream direction. The system further can include a merging station that can receive the clipped assembly from the clipping station. The merging station can move articles of the plurality of articles toward one another while the keel portion of the blank folds between the articles to form a keel between the articles as the clipped assembly is moved in the downstream direction.

Additional aspects, features, and advantages of the present invention will become apparent from the following description and accompanying figures.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a system and method of forming packages that can include carriers holding containers or other articles. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof. Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

Figure 1:
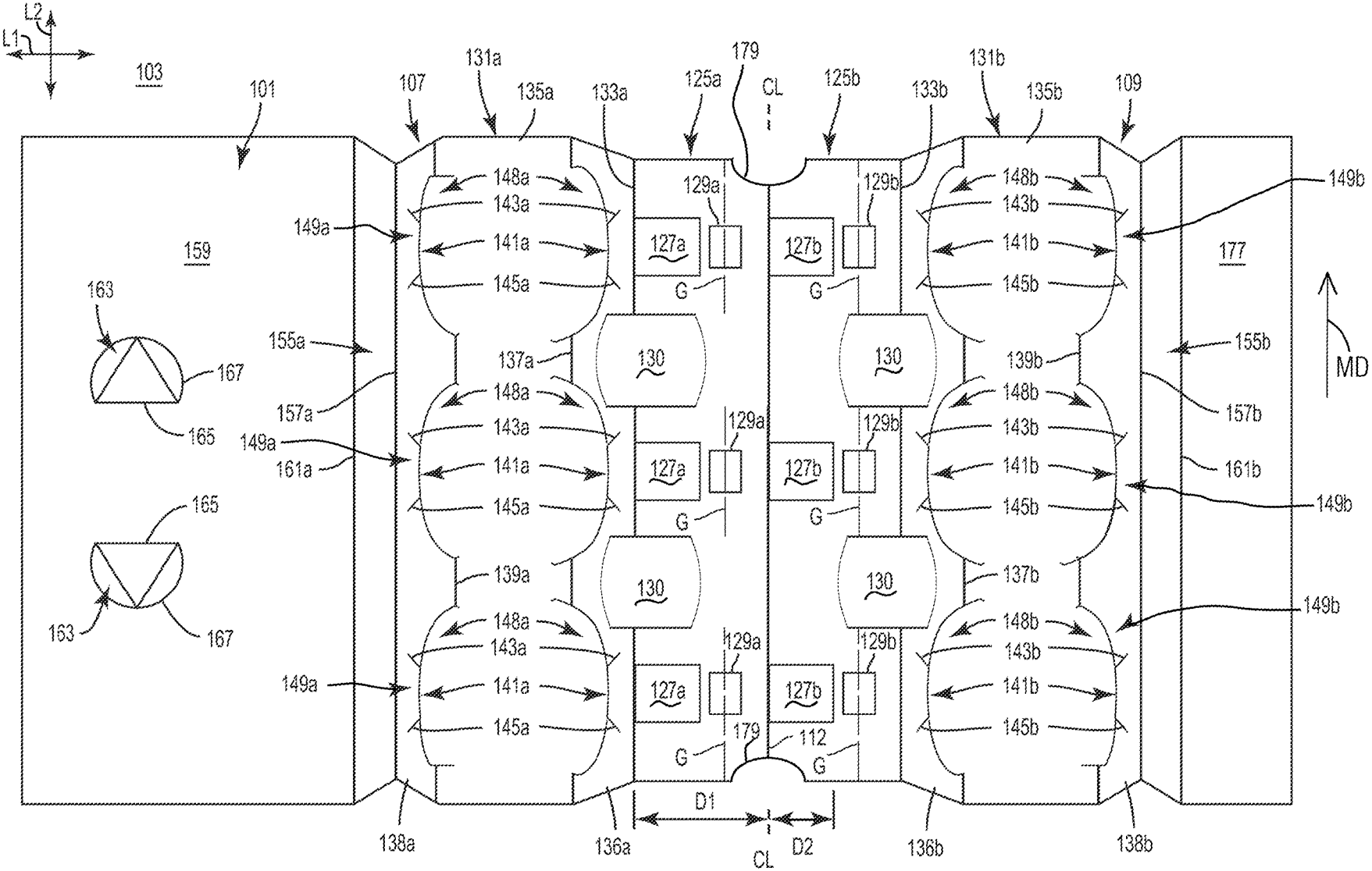
FIG. 1 is a plan view of an outer surface of a blank for forming a carrier according to an exemplary embodiment of the disclosure.
Figure 5:
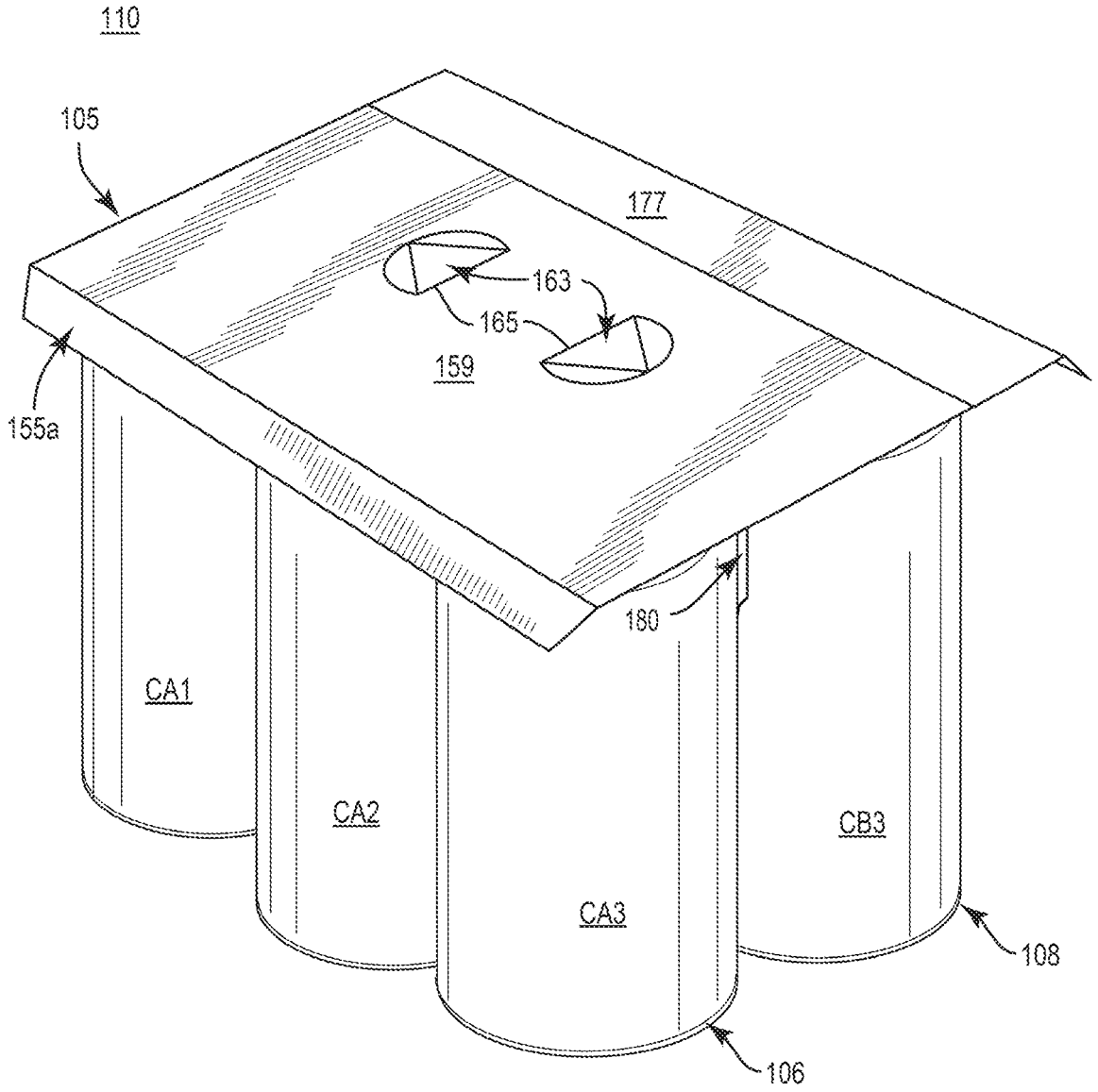
FIG. 5 is a perspective view of a package formed from the clipped assembly of FIGS. 2 and 3 according to the exemplary embodiment.

FIG. 1 shows a plan view of an exterior side 101 of a blank 103 used to form a carrier 105 (FIG. 5) in accordance with a first exemplary embodiment of the disclosure. The carrier 105 can be provided together with one or more containers C as a package 110 (FIG. 5). In some embodiments, the carrier 105 and the package 110 can be similar or identical to one or more of the carriers and packages disclosed in the incorporated-by-reference applications identified above. Generally, one embodiment of the system and method of the present disclosure can feed a series of blanks (e.g., the blank 103) and a plurality of articles (e.g., the containers C) in a machine direction (e.g., as indicated by arrow MD in FIG. 1 in an exemplary embodiment), can bring the blanks and the articles together to clip or otherwise attach the blanks to the articles, and can continue moving the attached blanks and articles while applying glue and folding aspects of the blanks to form the carriers (e.g., the carrier 105) and the packages (e.g., the package 110). In alternative embodiments, the blank 103 could be otherwise oriented with respect to the machine direction MD (e.g., the arrow MD could be reversed in FIG. 1).

As shown in FIG. 5, the carrier 105 is sized to contain or support six containers C, with three containers CA1, CA2, CA3 being attached to a first or left portion 106 of the carrier 105 and three containers CB1, CB2, CB3 being attached to a second or right portion 108 of the carrier 105. In the illustrated embodiment, the containers CA1, CA2, CA3, CB1, CB2, CB3 can be beverage cans, or could be any other suitable type and size of container without departing from the disclosure. The carrier 105 can be sized and shaped to hold more or less than six containers. In one embodiment, the first portion 106 and the second portion 108 of the carrier 105 each have three containers, and in other embodiments, the first portion 106 and the second portion 108 of the carrier 105 can carry more or less than three containers without departing from the disclosure.

Figure 2:
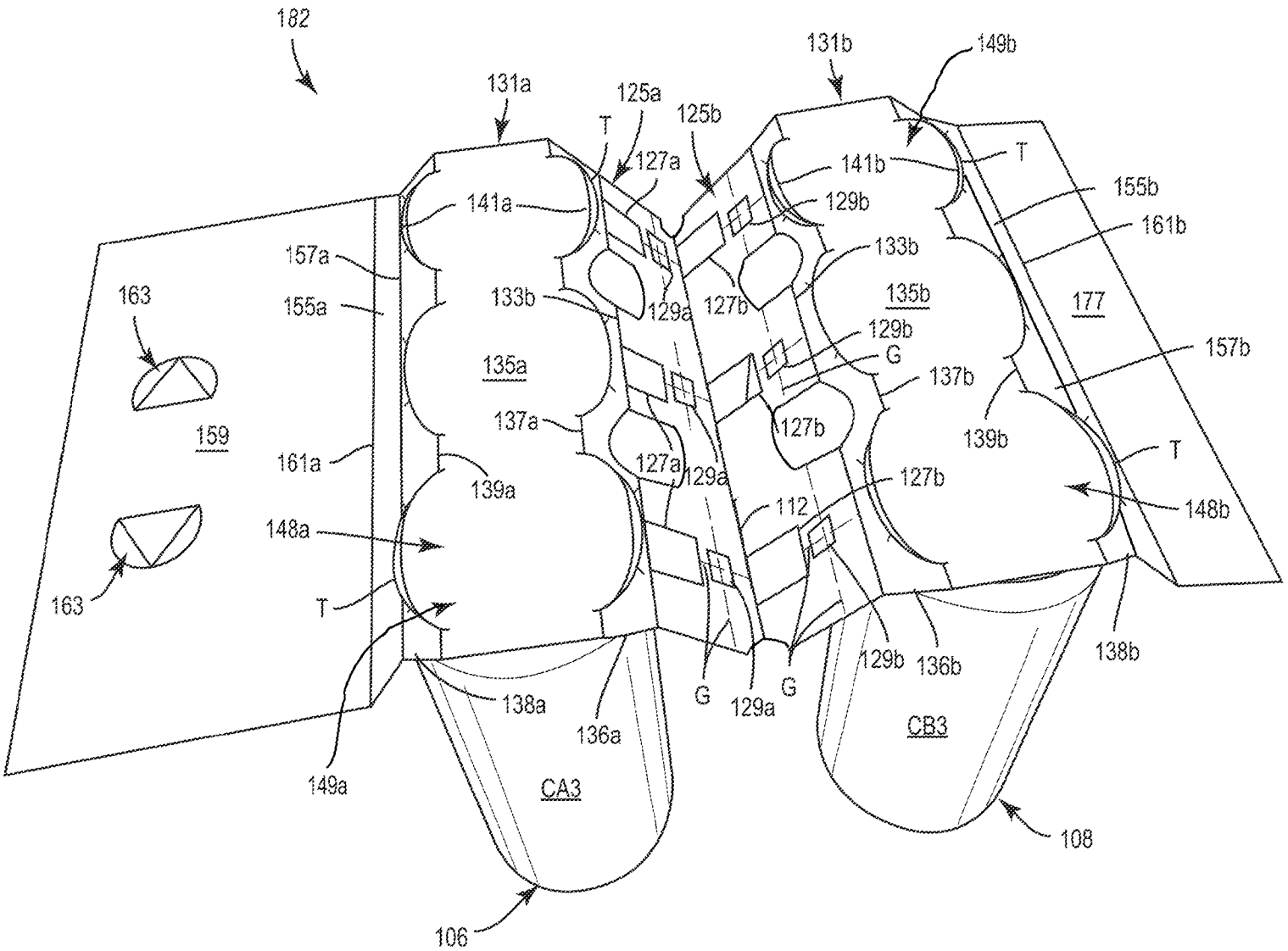
FIGS. 2 and 3 are perspective views of a clipped assembly formed from the blank of FIG. 1 and articles according to the exemplary embodiment.
Figure 4:
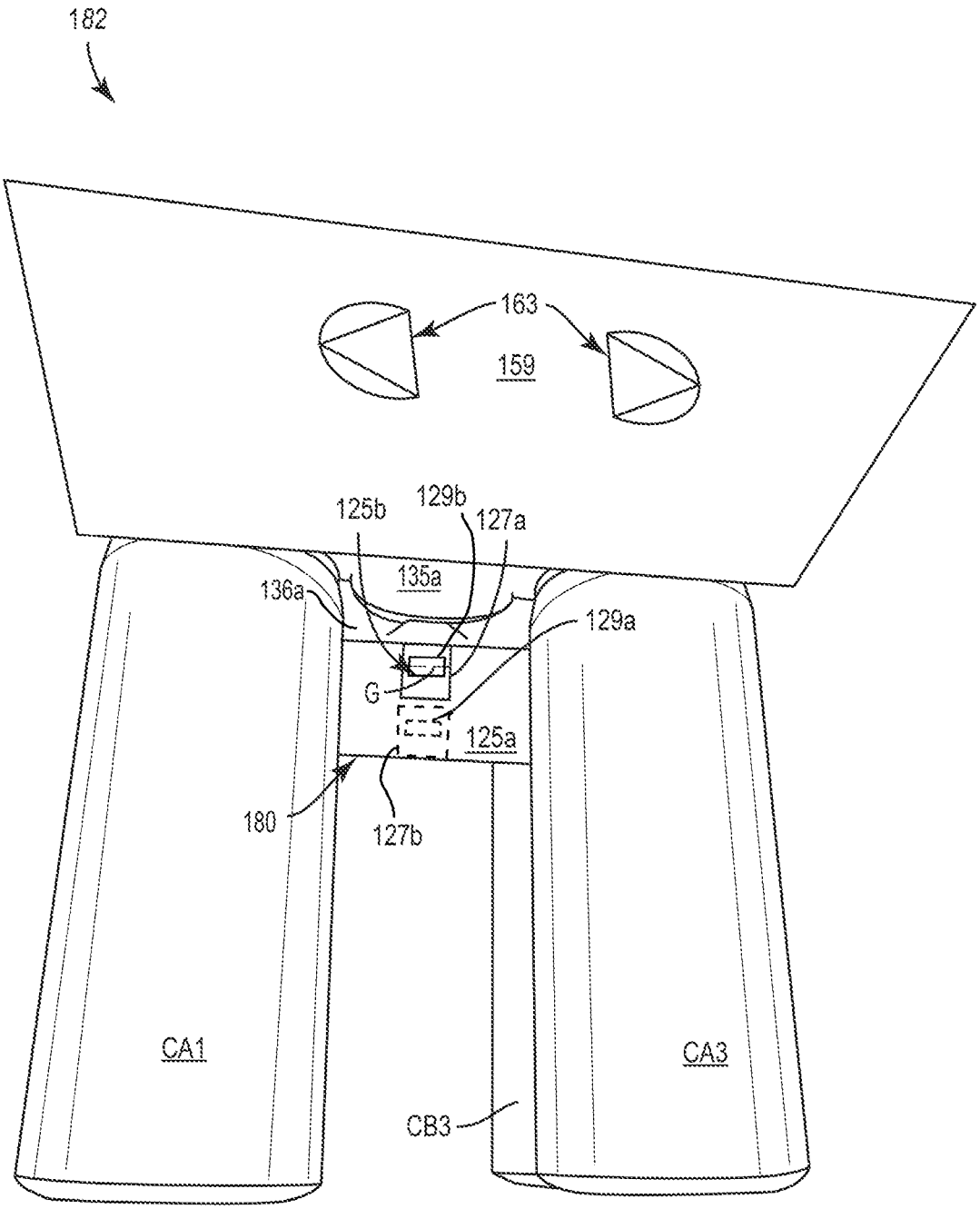
FIG. 4 is a perspective view of the clipped assembly of FIGS. 2 and 3 with a pair of containers removed.

As shown in FIG. 1, the blank 103 has a longitudinal axis L1 and a lateral axis L2. The blank 103 has a first side 107 for forming the first portion 106 of the carrier 105, and a second side 109 for forming the second portion 108 of the carrier 105. In the illustrated embodiment, the blank 103 can be moved in a system for forming the packages 110 (e.g., the system 200 described in more detail below) with the first side 107 on the left side of the system and the second side 109 on the right side of the system as determined when viewing in the downstream machine direction as indicated by arrow MD in FIG. 1. The first side 107 and the second side 109 of the blank 103 are foldably connected at a lateral fold line 112 that forms a lateral centerline CL of the blank 103, as shown. In the illustrated embodiment, the first side 107 of the blank 103 comprises a first central panel 125*a* having a pair of adhesive or glue openings 127*a* at interior portions thereof and a pair of surface features or areas 129*a* adjacent the respective glue openings 127*a*. As shown in FIGS. 1, 2, and 4, the surface areas 129*a* are schematically represented by rectangles, which may not be visible on the actual blank. In some embodiments, the surface features 129*a* can be, for example, an embossed feature or other at least partially raised or recessed surface configuration. In some embodiments, the surface features 129*a* can be omitted.

In the illustrated embodiment, a first container retention panel or first attachment panel 131*a* is foldably connected to the first central panel 125*a* at a lateral fold line 133*a*. The first attachment panel 131*a* includes a container retention portion 135*a* (e.g., crown panel) that is at least partially defined between a pair of longitudinally-spaced lateral fold lines 137*a*, 139*a* that are each interrupted by a respective pair of longitudinally-spaced cuts 141*a* that can each include one or more curved and/or angled portions. As shown, the longitudinally-spaced cuts 141*a* define container retention tabs 148*a* (e.g., crown tabs) that extend outwardly from the container retention portion 135*a*. As also shown, respective oblique cuts 143*a*, 145*a* extend outwardly from each respective cut 141*a* to form flexible retention edges in the first attachment panel 131*a* for engaging top portions (e.g., chimes) of respective containers. In one embodiment, each pair of cuts 141*a* can at least partially define a clipping feature 149*a* in the first attachment panel 131*a* for engaging a respective container CA1, CA2, CA3.

As shown in FIG. 1, an interior marginal portion 136*a* of the attachment panel 131*a* is defined between the fold lines 137*a*, 133*a*, and an exterior marginal portion 138*a* of the attachment panel 131*a* is defined between the fold line 139*a* and a lateral fold line 157*a*. A bevel or first side panel 155*a*, as shown, is foldably connected to the first attachment panel 131*a* at the lateral fold line 157*a*, and a top panel 159 (e.g., a first top panel 159) is foldably connected to the first side panel 155*a* at a lateral fold line 161*a*.

In the illustrated embodiment, the second side 109 of the blank 103 includes a second central panel 125*b*, a second container retention panel or second attachment panel 131*b*, and a second side panel 155*b* having associated features that are generally a mirror-image of the corresponding panels and flaps of the first side 107 of the blank 103. Corresponding components (e.g., panels, flaps, fold lines, cuts, etc.) have been designated by corresponding reference numbers that differ by the "a" or "b" suffix, with the "a" components corresponding to the first side 107 of the blank 103 and the "b" components corresponding to the second side 109 of the blank 103. The second side 109 of the blank 103 also includes an attachment flap 177 (e.g., a second top panel 177) foldably connected to the second side panel 155*b* at a lateral fold line 161*b*.

In the illustrated embodiment, the blank 103 can include grasping or gripping features that include a pair of grip flaps 163 (broadly, respective first and second handle, grasping, or gripping features) that are each foldably connected to the top panel 159 at a respective fold line 165 and which are at least partially defined by a respective curved cut 167. The gripping features also can include grip openings 130 extending in the central panels 125*a*, 125*b* and in the interior marginal portions 136*a*, 136*b*. In one embodiment, the grip openings 130 can provide clearance for the grip flaps 163 and/or for a user's fingers when grasping the carrier 105 at the gripping features. The blank 103 and the carrier 105 can have a different arrangement of gripping features, or can be devoid of gripping features, without departing from the disclosure.

As shown in FIG. 1, the top edges of the respective glue openings 127*a* are spaced a longitudinal distance D1 away from the centerline CL that is greater than a longitudinal distance D2 that the top edges of respective glue openings 127*b* of the second side 109 of the blank 103 are spaced away from the centerline CL. In another embodiment, each of the glue openings 127*a*, 127*b* can be replaced by a set of four glue openings or any suitable number of glue openings, which can be spaced along the longitudinal direction L1. For example, each set of four glue openings can include glue openings that are aligned or at least partially aligned in the longitudinal direction L1. Each of the glue openings in each set of glue openings in the first central panel 125*a* can be differently spaced from the lateral fold line 112 than each of the glue openings in the respective sets of glue openings in the second central panel 125*b*.

As shown in FIG. 1, the blank 103 can include two lug notches 179 for engaging features in the system 200 as described in more detail below. In the illustrated embodiment, the lug notches 179 can extend from the respective longitudinally-extending, leading and trailing edges of the blank 103 in the central panels 125*a*, 125*b* (e.g., centered on the centerline CL).

Any of the panels, flaps, fold lines, cuts, or other features could be otherwise shaped, arranged, and/or omitted from the blank 103 without departing from the disclosure. The blank 103 could be sized and/or shaped to accommodate more or less than six containers without departing from this disclosure.

As shown in FIG. 1, glue G can be applied to one or more portions of the central panels 125*a*, 125*b*, e.g., across the respective surface areas 129*a*, 129*b*. While the glue G is illustrated on the exterior surface 101 of the blank 103 in FIG. 1 for clarity of illustration and to indicate positioning relative to other features of the blank 103, it will be understood that the glue G is applied to at least the interior surface of the central panels 125*a*, 125*b* as shown in FIG. 2. In one embodiment, glue G can be applied to both the interior surface and the exterior surface of the central panels 125*a*, 125*b*. The glue G can be applied in multiple beads on each of the central panels 125*a*, 125*b* as shown in FIGS. 1 and 2 and the beads can be arranged in one row or any suitable number of rows on each of the central panels 125*a*, 125*b*. Alternatively, each of the central panels 125*a*, 125*b* could include one long bead of glue G.

As shown in FIG. 2, the exterior surface 101 of the blank 103 can be placed atop the containers CA1, CA2, CA3, CB1, CB2, CB3 such that the container retention portion 135*a* of the first attachment panel 131*a* overlies the containers CA1, CA2, CA3 and such that the container retention portion 135*b* of the second attachment panel 131*b* overlies the containers CB1, CB2, CB3. Further downward positioning of the attachment panels 131*a*, 131*b* over the plurality of containers CA1, CA2, CA3, CB1, CB2, CB3 can activate the respective container retention portions 135*a*, 135*b* to engage respective containers. For example, as the first attachment panel 131*a* is lowered or urged downwardly onto the containers CA1, CA2, CA3, the container retention portion 135*a* can engage the tops T of the containers as the marginal portions 136*a*, 136*b* are folded downwardly with respect to the container retention portion 135*a*. This can cause the container retention portion 135*a* to at least partially separate from the remainder of the first attachment panel 131*a* at the cuts 141*a* to form retention edges in the marginal portions 136*a*, 138*a*. As the marginal portions 136*a*, 138*a* are further folded downwardly, the upper or top portions T (e.g., the chimes) of the respective containers CA1, CA2, CA3 can extend at least partially through respective openings formed by the respective cuts 141*a* and the retention edges can engage under the chimes of the containers CA1, CA2, CA3 so that the blank 103 is now attached (clipped) to the containers CA1, CA2, CA3. Such reconfiguration of the corresponding portions of the second attachment panel 131*b* can occur as the second attachment panel 131*b* is lowed or urged downwardly onto the containers CB1, CB2, CB3. The marginal portions 136*a*, 138*a* of the attachment panel 131*a* can fold at least partially downwardly at the respective fold lines 137*a*, 139*a* in such a configuration, and, similarly, the marginal portions 136*b*, 138*b* of the attachment panel 131*b* can fold at least partially downwardly at the respective fold lines 137*b*, 139*b*. In some embodiments, the marginal portions 136*a*, 138*a*, 136*b*, 138*b* can extend obliquely from the top portions T to the shoulders of the containers for containers with rims that have a smaller diameter than the sides of the containers. In some other embodiments in which the containers have top portions with a similar diameter as the sides of the containers, the marginal portions can extend vertically or nearly vertically from the chimes of the containers.

As shown in FIG. 2, the first central panel 125*a* and the second central panel 125*b* can be folded at the fold line 112 such that the first central panel 125*a* and the second central panel 125*b* are brought into at least partial face-to-face contact and such that the respective glue openings 127*a*, 127*b* and the respective surface areas 129*a*, 129*b* in the respective central panels 125*a*, 125*b* are positioned so as to be laterally aligned but longitudinally offset due to the different relative spacing of the respective glue openings 127*a*, 127*b* away from the centerline CL. In this regard, the central panels 125*a*, 125*b* are arranged such that a portion of the first central panel 125*a* overlaps each of the glue openings 127*b* and a portion of the second central panel 125*b* overlaps each of the glue openings 127*a* to provide communication between the central panels 125*a*, 125*b* and respective surfaces upon which the respective containers CA1, CA2, CA3, CB1, CB2, CB3 can be adhered or otherwise attached, as described further herein. Such rearrangement of the central panels 125*a*, 125*b* can also cause the respective central panels 125*a*, 125*b* to be folded downwardly relative to the respective attachment panels 131*a*, 131*b* at the respective fold lines 133*a*, 133*b*.

Figure 3:
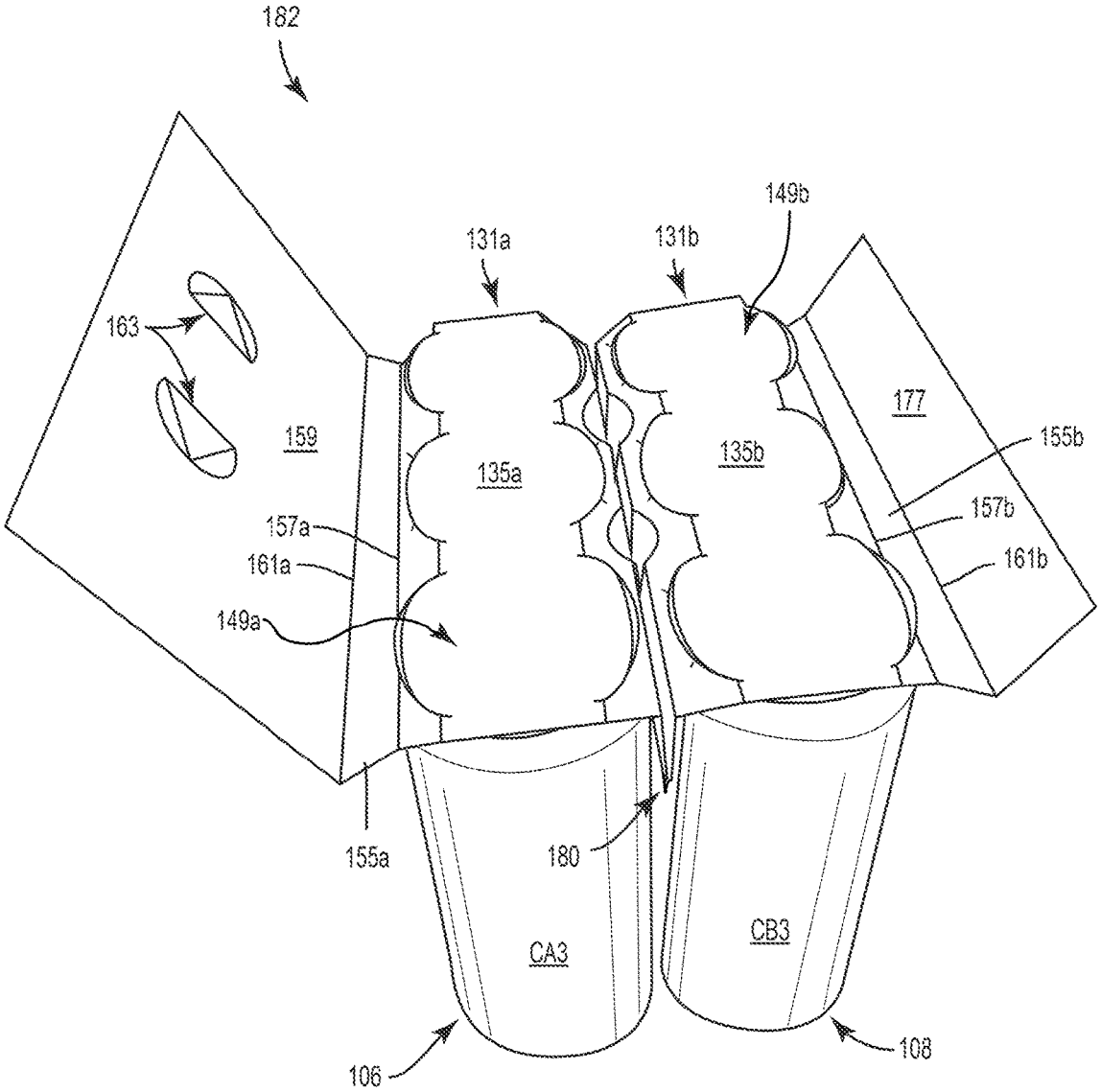

As shown in FIG. 3, when the central panels 125*a*, 125*b* are folded, brought into face-to-face contact, and adhered to the respective containers CB1, CB2, CB3 and CA1, CA2, CA3, the central panels 125*a*, 125*b* generally can form a keel 180 extending between the rows of the containers. Accordingly, in one embodiment, the central panels 125*a*, 125*b* can be considered a keel portion in the blank prior to folding the central panels 125*a*, 125*b* to form the keel 180.

Referring to FIG. 4, in which the containers CA2, CB2 are removed for clarity of illustration, glue G can be at least partially aligned with the glue openings 127*a* to adhere the containers CA1, CA2, CA3 to respective exposed portions of the central panel 125*b* through the respective glue openings 127*a*. Similarly, the glue G can be at least partially aligned with the respective glue openings 127*b* to adhere the containers CB1, CB2, CB3 to respective exposed portions of the central panel 125*a* through the respective glue openings 127*b*. The glue G can cover at least a portion of the surface areas 129*a*, 129*b* such that one or more of the surface areas 129*a*, 129*b* presents additional surfaces for adhesion and/or spacing between the first portion 106 and the second portion 108 of the carrier 105.

The attachment of the containers CA1, CA2, CA3, CB1, CB2, CB3 to the respective central panels 125*a*, 125*b* can provide retention and support of the respective containers, e.g., such that the containers do not detach from the carrier 105 under their own weight, in addition to or alternative to the container retention and support provided by the respective container retention portions 135*a*, 135*b*. The glue G described herein can be, for example, a hot melt adhesive, a high tack glue, an epoxy, a polymeric cement, etc., or combinations thereof.

As shown in FIGS. 2, 3, and 5, the first side panel 155*a* can be folded upwardly at the fold line 157*a* to be at a vertical arrangement or at an oblique arrangement relative to the containers CA1, CA2, CA3, CB1, CB2, CB3 and the top panel 159 can be folded at the fold line 161*a* into at least partial face-to-face contact with at least a portion of the attachment panels 131*a*, 131*b*. Similarly, the second side panel 155*b* can be folded upwardly at the fold line 157*b* into a vertical arrangement or an oblique arrangement with the containers CA1, CA2, CA3, CB1, CB2, CB3, and the attachment flap 177 can be folded at the fold line 161*b* into at least partial face-to-face contact with the attachment panel 131*b*, as shown in FIG. 5. Such an arrangement can be maintained with an adhesive such as glue. For example, glue can be applied to the container retention portions 135*a*, 135*b* and/or to the top panel 159 and the attachment flap 177 prior to folding the top panel 159 and the attachment flap 177 into face-to-face contact with the container retention portions 135*a*, 135*b*. In the illustrated embodiment, the top panel 159 and the attachment flap 177 are folded so that the laterally-extending edges of the top panel 159 and the attachment flap 177 are proximate and/or abutting one another. Alternatively, the top panel 159 and the attachment flap 177 can be spaced apart from one another or can be in an at least partially overlapping relationship.

Accordingly, containers can be engaged by the respective attachment panels 131*a*, 131*b* and can extend below the respective container retention portions 135*a*, 135*b* in the assembled package 110 shown in FIG. 5. In such an arrangement, the containers CA1, CA2, CA3 extend below the container retention portion 135*a* in the first portion 106 of the carrier 105, and the containers CB1, CB2, CB3 extend below the container retention portion 135*b* in the second portion 108 of the carrier 105, with the top panel 159 and the attachment flap 177 overlying respective portions of the respective container retention portions 135*a*, 135*b*. Further, the keel 180, including the first central panel 125*a* and the second central panel 125*b*, is positioned between and attached to the containers CB1, CB2, CB3, CA1, CA2, CA3.

Figure 6:
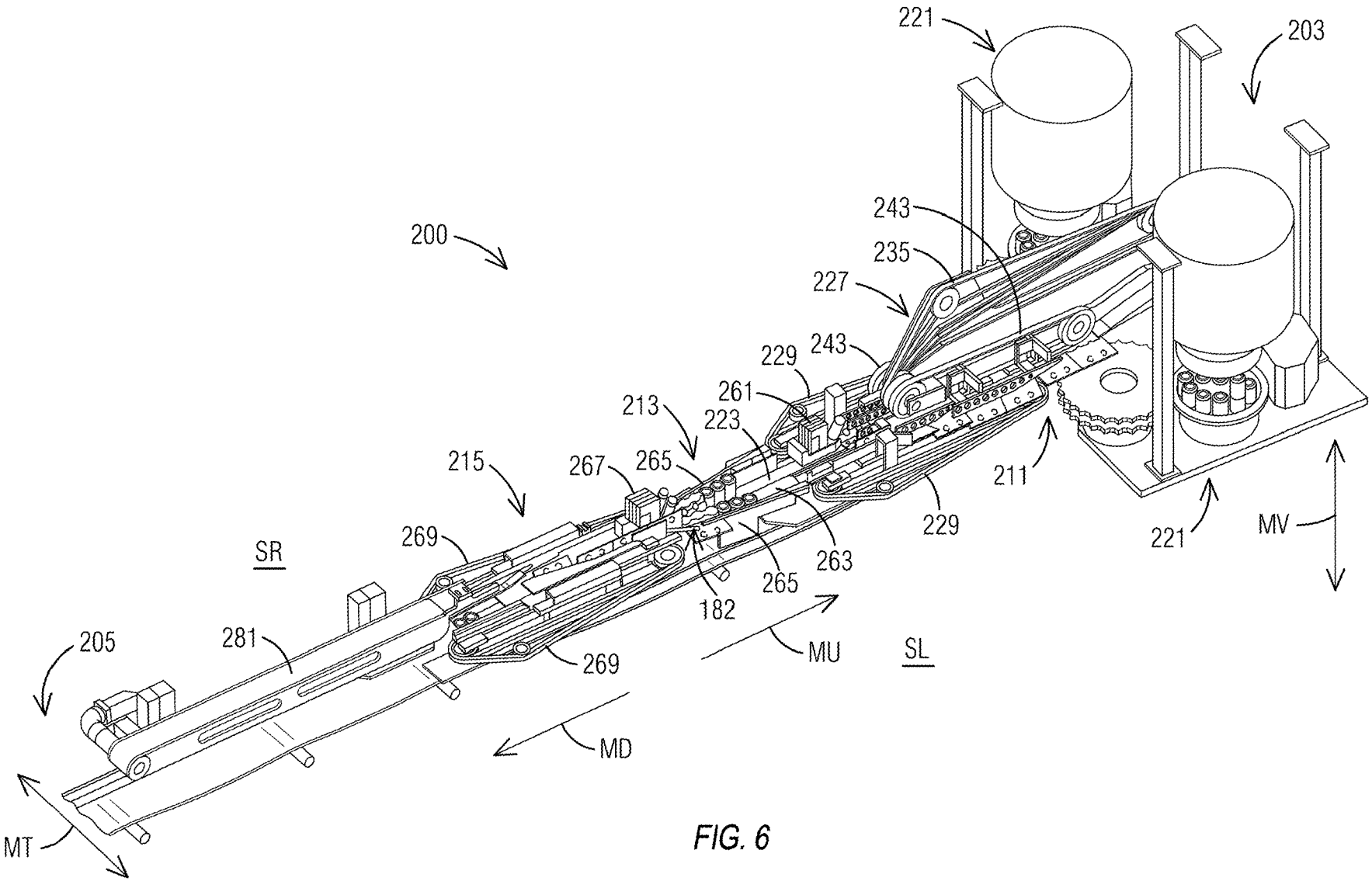
FIG. 6 is a schematic perspective view of a system and method for folding forming the clipped assembly of FIGS. 2 and 3 and forming the package of FIG. 5 an exemplary embodiment of the disclosure.

FIGS. 6-15 illustrate various example embodiments and components of systems and methods 200 for forming the packages (e.g., packages 110) in accordance with the disclosure. In the illustrated embodiment, as schematically shown, for example, in the product flow of FIG. 15, the packaging system 200 generally feeds the containers C and blanks (e.g., blank 103) at an upstream end 203 of the system 200, clips the blanks 103 onto a group of the containers C (e.g., the containers CA1, CA2, CA3, CM, CB2, CB3) to form a clipped assembly 182 (the blanks 103 attached to the respective containers C), folds portions of the blanks 103 and moves the group of containers C together to form the keels (e.g., keels 180), and folds portions of the blanks 103 to form carriers (e.g., carrier 105). The blanks 103 and the containers C can move through the system 200 to a downstream end 205 generally in a downstream machine direction MD (downstream direction). As shown in FIG. 6, the upstream direction MU of the system 200 extends opposite to the downstream direction MD. Further, the system 200 can have a horizontal transverse direction MT that is transverse to the downstream direction MD and a vertical direction MV that is transverse to the downstream direction MD. In the present application, the system 200 can have a left side SL and a right side SR, which are determined while looking in the downstream direction MD. In one embodiment, the system 200 of the present disclosure includes a clipping station 211 that brings the blanks 103 and the group of containers C together to form the clipped assembly 182 (FIGS. 2-4, 9, and 11), a merging station 213 that moves the containers C together and forms the keel 180, and a folding station 215 that folds the side panels and top panels of the blank 103 to form the carrier 105.

In the illustrated embodiment, the blanks 103 can be fed to the clipping station 211 at the upstream end 203 by a carton feeder (e.g., a pick-and-place carton feeder, a belt feeder, conveyor belt, or any other suitable feeder and/or conveyor), not shown, and the containers C can be fed to the clipping station 211 in two streams. In one embodiment, the system can include a pair of orientation units 221 (FIG. 6), which can selectively rotate the individual containers C so that the containers C are fed to the clipping station 211 with a predetermined orientation (e.g., to ensure that one or more of the universal product codes or other information on the containers C are inward-facing and are hidden by the other containers C in the package 110 and/or to ensure that a label or other information on the containers C is facing outwardly in the resulting package 110). In the illustrated embodiment, the orientation units 221 can receive the containers C from the respective infeed conveyors (not shown), and output the containers C in the predetermined orientation onto respective upstream conveyors 223 (FIGS. 7, 10, and 12) of the system 200, wherein the two upstream conveyors 223 (e.g., a first upstream conveyor 223 and a second upstream conveyor 223) can move the containers C in the downstream direction in a respective first stream and second stream along a portion of the system 200. Alternatively, the orientation assemblies 221 could be omitted or bypassed so that the containers C can be fed directly to the clipping station 211. Further, in other embodiments, the containers C could be otherwise fed to the upstream conveyors 223.

Figure 7:
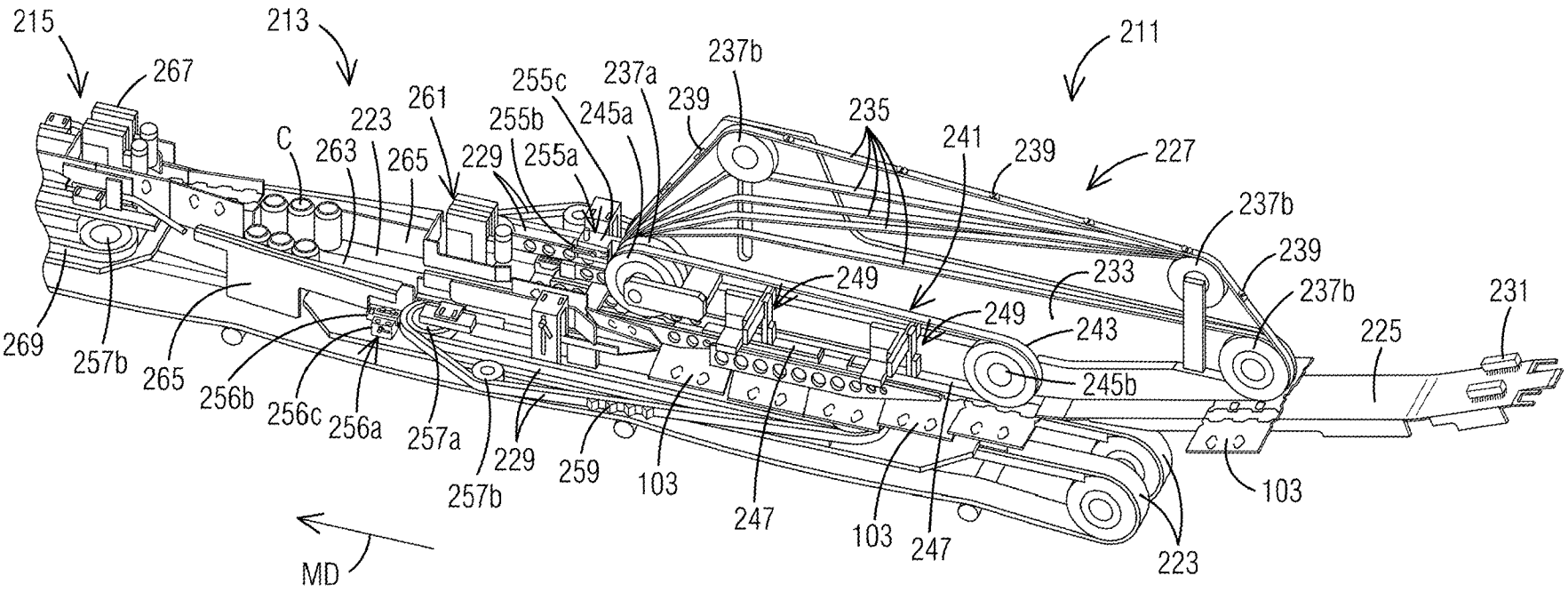
FIG. 7 is a schematic perspective view of a clipping station and a merging station of the system of FIG. 6.
Figure 8:
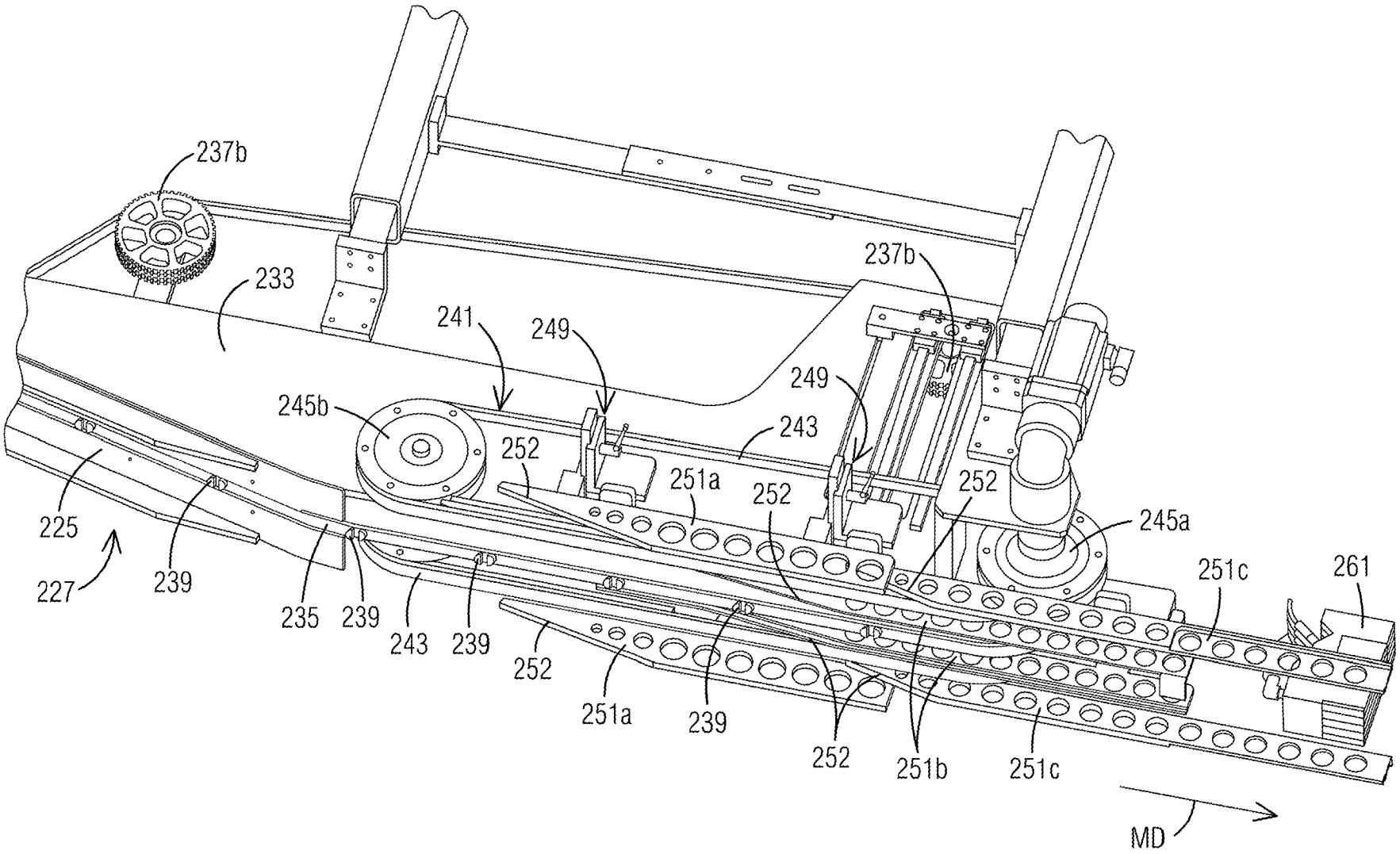
FIGS. 8-10 are schematic perspective views of portions of the clipping station of FIGS. 6 and 7.

As shown in FIGS. 7 and 8, the clipping station 211 can include a support plate 225 (FIGS. 7 and 8) at the upstream end of the clipping station 211, an overhead assembly 227 (FIG. 8) for moving and guiding the blanks 103, and two upstream side transport belts or upstream metering belts 229 (FIGS. 7, 9, 10, and 12) on opposite sides of the upstream conveyors 223. There are multiple upstream metering belts 229 shown schematically on each side of the system 200 in FIGS. 6 and 7 to illustrate that different belts can be used in the system 200; however, only one upstream metering belt 229 would be included at a time on each side of the system, the belts being selected with an appropriate length and configuration for the size (e.g., diameter) of the containers C being packaged, as described in more detail below. In the illustrated embodiment, the support plate 225 can be inclined and can guide the blanks 103 received from the carton feeder as the blanks 103 move along the support plate 225 (e.g., by one or more belts or other conveyors mounted along at least a portion of the support plate 225 and/or by sliding due to gravity). A set of brushes 231 (FIG. 7) can be positioned at the upstream end of the support plate 225, above the blanks 103, for controlling the movement of the blanks 103. Alternatively, the brushes 231 could be omitted or could be mounted below the blanks 103 and/or could be replaced by other features that can slow or otherwise control the blanks 103 as they slide along the support plate 225. The support plate 225 could be omitted or could be otherwise arranged, shaped, positioned, or configured without departing from the disclosure.

Figure 9:
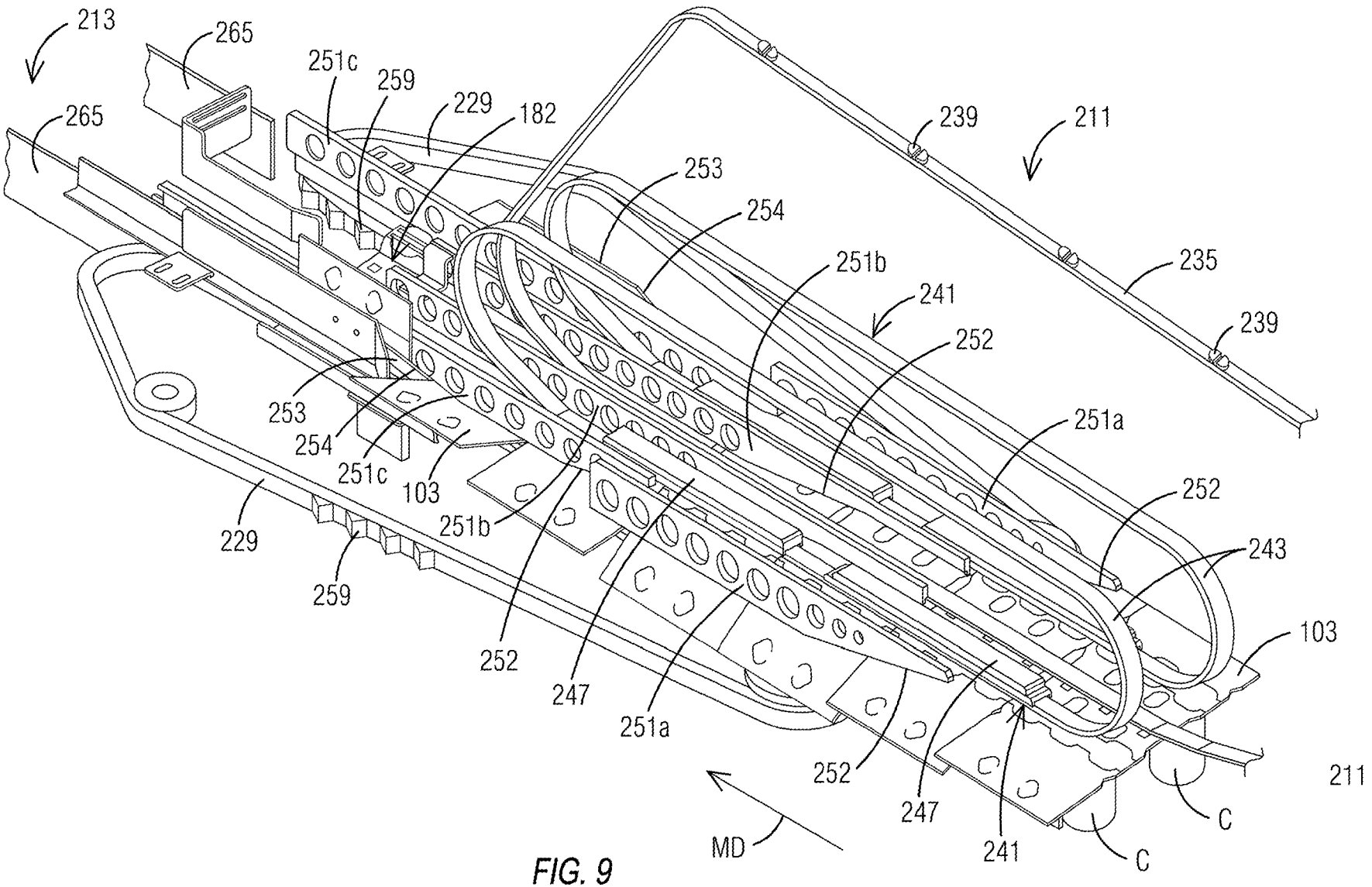

In the illustrated embodiment, the overhead assembly 227 can include a frame plate 233 (FIGS. 7 and 8) that is mounted above at least a portion of the upstream conveyors 223. A blank flight belt or lug belt 235 can be mounted to the frame plate 233 by a drive wheel 237*a* and guide wheels 237*b*. There are multiple lug belts 235 shown schematically in FIGS. 6 and 7 to illustrate that different lug belts 235 can be used in the system 200; however, only one lug belt 235 would be used in the system 200, the lug belt being selected with an appropriate length and lug spacing for the blanks handled by the system 200, as described in more detail below. In one embodiment, the drive wheel 237*a* can move the lug belt 235 along the wheels in time with (e.g., at the same rate as) the upstream conveyors 223 with the bottom portion of the lug belt 235 moving in the downstream direction MD through the clipping station 211. As shown in FIGS. 7-9, a plurality of lugs 239 are spaced along the lug belt 235 for engaging the blanks 103 and moving the blanks 103 in the downstream direction MD along the clipping station 211. In one embodiment, each of the lugs 239 engages a lug notch 179 in a trailing edge of one blank 103 and a lug notch 179 in the leading edge of a blank 103 that is adjacent and upstream from the first blank 103. In an exemplary embodiment, the lugs 239 can be sized so that the blanks 103 can abut one another or can be otherwise arranged with respect to one another so that the blanks 103 can be clipped to the containers C while the containers C are in a product pitch arrangement (e.g., each of the containers abut the respectively adjacent upstream and downstream containers so that the containers are not spaced apart along each of the streams). In one embodiment, the support plate 225 can include a slot (FIG. 8) that can accommodate the lugs 239 as the lug belt 235 moves the blanks 103 along the support plate 225 to engagement with the containers C.

As shown in FIGS. 7-9, the overhead assembly 227 can include two pressing units 241 mounted on either side of the frame plate 233. In the illustrated embodiment, each of the pressing units 241 can include a guide belt 243 mounted to the frame plate 233 on a drive wheel 245*a* and a guide wheel 245*b*. In addition, each of the pressing units 241 can include one or more guide bars 247 mounted to the frame plate 233 by adjustable brackets 249 (FIGS. 7 and 8). In the illustrated embodiment, the guide bars 247 can press downwardly on the lower portion of the guide belts 243, wherein the lower portions of the guide belts 243 are moving in the downstream direction MD. In one embodiment, the pressing units 241 can help hold the blanks 103 against the tops T of the containers C. In some embodiments in which it is desirable to maintain the orientation of the containers C (e.g., as set by the optional orientation units 221) as they move through the clipping station 211, the downward pressure of the pressing units 241 on the containers C (e.g., against the upstream conveyors 223 supporting the containers C from below) can help prevent the containers C from rotating as they are moved in the downstream direction MD. In other embodiments, the pressing units 241 can be configured to help hold the blanks 103 against the tops T of the containers C without regard to preventing rotation of the containers or the pressing units 241 could be omitted. In one embodiment, the drive wheel 245*a* can move the guide belt 241 along the wheels in time with (e.g., at the same rate as) the lug belt 235 and the upstream conveyors 223 with the bottom portion of the guide belt 243 moving in the downstream direction MD through the clipping station 211.

Figure 10:
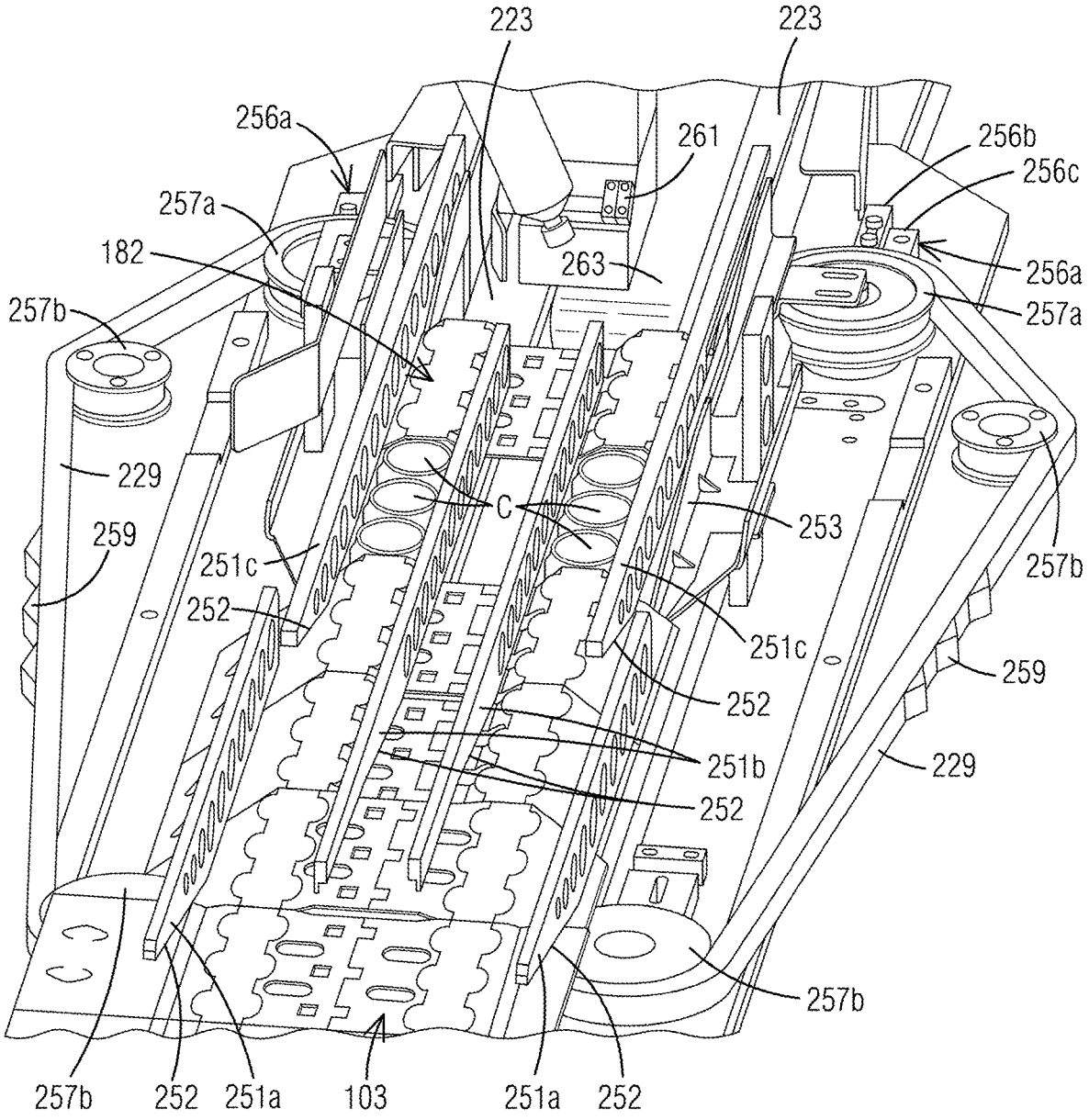

As shown in at least FIGS. 8-10, the overhead assembly 227 further can include two outer clipping guides 251*a*, two inner clipping guides 251*b*, and two tension guides 251*c* for clipping the blanks 103 to the containers C as the blanks 103 and the containers C move through the clipping station 211. In the illustrated embodiment, the clipping guides 251*a*, 251*b*, 251*c* can be mounted to the frame plate 233 (e.g., via the adjustable brackets 249) and/or to other features of the system. As shown in at least FIGS. 8-10, the clipping guides 251*a*, 251*b*, 251*c* can be mounted over the blanks 103 and can have sloped upstream ends or sloped surfaces 252 that engage (e.g., contact) and gradually push respective portions of the blanks 103 downwardly as the blanks 103 are moved in the downstream direction in the clipping station 211. In the illustrated embodiment, the outer clipping guides 251*a* can be spaced outwardly (e.g., in the transverse direction MT) from the inner clipping guides 251*b* and the tension guides 251*c* so that the outer clipping guides 251*a* engage the outer portions (e.g., the exterior marginal portions 138*a*, 138*b*, the side panels 155*a*, 155*b*, and/or the top panels 159, 177) of the blanks 103. Positioned partially downstream from the outer clipping guides 251*a*, the inner clipping guides 251*b* can be mounted inside (e.g., immediately inside) the two streams of containers C on the respective upstream conveyors 223 for engaging inner portions (e.g., the interior marginal portions 136*a*, 136*b* and/or the central panels 125*a*, 125*b*) of the blanks 103 (FIG. 10). The inner clipping guides 251*b* can engage the interior marginal portions 136*a*, 136*b* initially to provide tension on the inner portions of the blanks 103 as the outer clipping guides 251*a* force the outer portions of the blank downwardly, which can at least partially cause the exterior marginal portions 138*a*, 138*b* to engage the chimes of the containers C. In one embodiment, the outer clipping guides 251*a* can engage the exterior marginal portions 138*a*, 138*b* to press the exterior marginal portions 138*a*, 138*b* downwardly with respect to the container retention portions 135*a*, 135*b*, folding the exterior marginal portions 138*a*, 138*b* downwardly along the lateral fold lines 139*a*, 139*b* and engaging the chimes at the tops T of the containers C with the respective retention edges formed in the exterior marginal portions 138*a*, 138*b* by the cuts 141*a*, 141*b*. In some embodiments, the pressing units 241 (FIG. 9) can help hold the blanks 103 in place (e.g., by pressing the container retention portions 135*a*, 135*b* of the blanks against the top portions T of the containers C) while the clipping guides engage the blanks to clip the blanks onto the containers.

In the illustrated embodiment, the tension guides 251*c* can be mounted outside (e.g., immediately outside) the two streams of containers C on the respective upstream conveyors 223 (FIG. 10) for engaging the outer portions of the blanks 103 (e.g., adjacent to where the exterior marginal portions 138*a*, 138*b* are clipped to the chimes of the containers C) to retain the exterior marginal portions 138*a*, 138*b* in clipped engagement with the containers C as the inner clipping guides 251*b* further press the interior marginal portions 136*a*, 136*b* downwardly to engage the chimes of the containers C. In one embodiment, the inner clipping guides 251*b* can press the interior marginal portions 136*a*, 136*b* downward with respect to the container retention portions 135*a*, 135*b*, folding the interior marginal portions 136*a*, 136*b* downwardly along the lateral fold lines 137*a*, 137*b* and engaging the chimes at the tops T of the containers C with the respective retention edges formed in the interior marginal portions 136*a*, 136*b* by the cuts 141*a*, 141*b*. Accordingly, the blanks 103 can be clipped to the containers C (e.g., the containers CA1, CA2, CA3, CB1, CB2, CB3 of FIGS. 2-5) by the clipping station 211 to form the clipped assemblies 182 as the containers C and the blanks 103 are moved in the downstream direction MD on the upstream conveyors 223 and by the lug belt 235. Any portion of the overhead assembly 211 could be omitted or could be otherwise arranged, shaped, positioned, or configured without departing from the disclosure.

In the illustrated embodiment, two or more initial plows 253 (FIGS. 9, 10, and 12) can be positioned at a downstream end of the clipping station 211 for engaging the top panels 159, 177 and/or the side panels 155*a*, 155*b* of the blanks 103 and gradually folding the top panels 159, 177 and the side panels 155*a*, 155*b* upwardly along at least the lateral fold lines 157*a*, 157*b*. In one embodiment, each of the initial plows 253 can be a vertical plate extending along the downstream direction MD on either side of the upstream conveyors 223 and can have an inclined upstream end 254. In an exemplary embodiment, the initial plows 253 can be spaced in the transverse direction MT in order to engage the top panels 159, 177 (e.g., adjacent the fold lines 161*a*, 161*b*) and/or the side panels 155*a*, 155*b* (e.g., adjacent the fold lines 157*a*, 157*b*). The inclined upstream ends 254 of the initial plows 253 can push the top panels 159, 177 and/or the side panels 155*a*, 155*b* upwardly so that the top panels 159, 177 or the side panels 155*a*, 155*b* and the top panels 159, 177 can be at least partially vertical as the clipped assemblies 182 are moved in the downstream direction MD (e.g., by the upstream conveyors 223). As the clipped assemblies 182 continue in the downstream direction MD, the top panels 159, 177 and/or the side panels 155*a*, 155*b* can engage the inner surfaces of the initial plows 253 (e.g., the surfaces facing the upstream conveyors 223), which can retain the top panels 159, 177 and the side panels 155*a*, 155*b* in the at least partially vertical position (FIG. 10).

As shown in FIGS. 7, 9, 10, and 12, the upstream metering belts 229 are positioned partially under the overhead assembly 227 on respective sides of the containers C carried on the upstream conveyors 223. In the illustrated embodiment, each of the upstream metering belts 229 can be mounted on a drive wheel 257*a* and guide wheels 257*b*. The upstream metering belts 229 can be driven on the wheels 257*a*, 257*b* so that the innermost (e.g., nearest the upstream conveyors 223) lengths of the upstream metering belts 229 are moved in the downstream direction MD in time with the lug belt 235 and the guide belts 243. In one embodiment, each of the upstream metering belts 229 can include wedge lugs or projections 259 (FIGS. 7, 9, 10, and 12, schematically showing some of the projections 259 along a portion of the length of the belts 229) spaced along the belts so that each projection 259 engages two adjacent containers C. The projections 259 can be curved, triangular, or otherwise contoured to engage portions of the sides of the cylindrical containers C and can be spaced to engage each container C between two projections 259 when the containers C are in a product pitch arrangement (e.g., engaged in contact with one another in each of the streams of containers) in an exemplary embodiment. In one embodiment, the upstream metering belts 229 can help move the containers C in the downstream direction MD in alignment with the respective clipping features 149*a*, 149*b* of the blanks 103 as the blanks 103 are located and moved by the lugs 239 on the lug belts 235. The upstream metering belts 229 could be omitted or could be otherwise arranged, shaped, positioned, or configured without departing from the disclosure.

Figure 12:
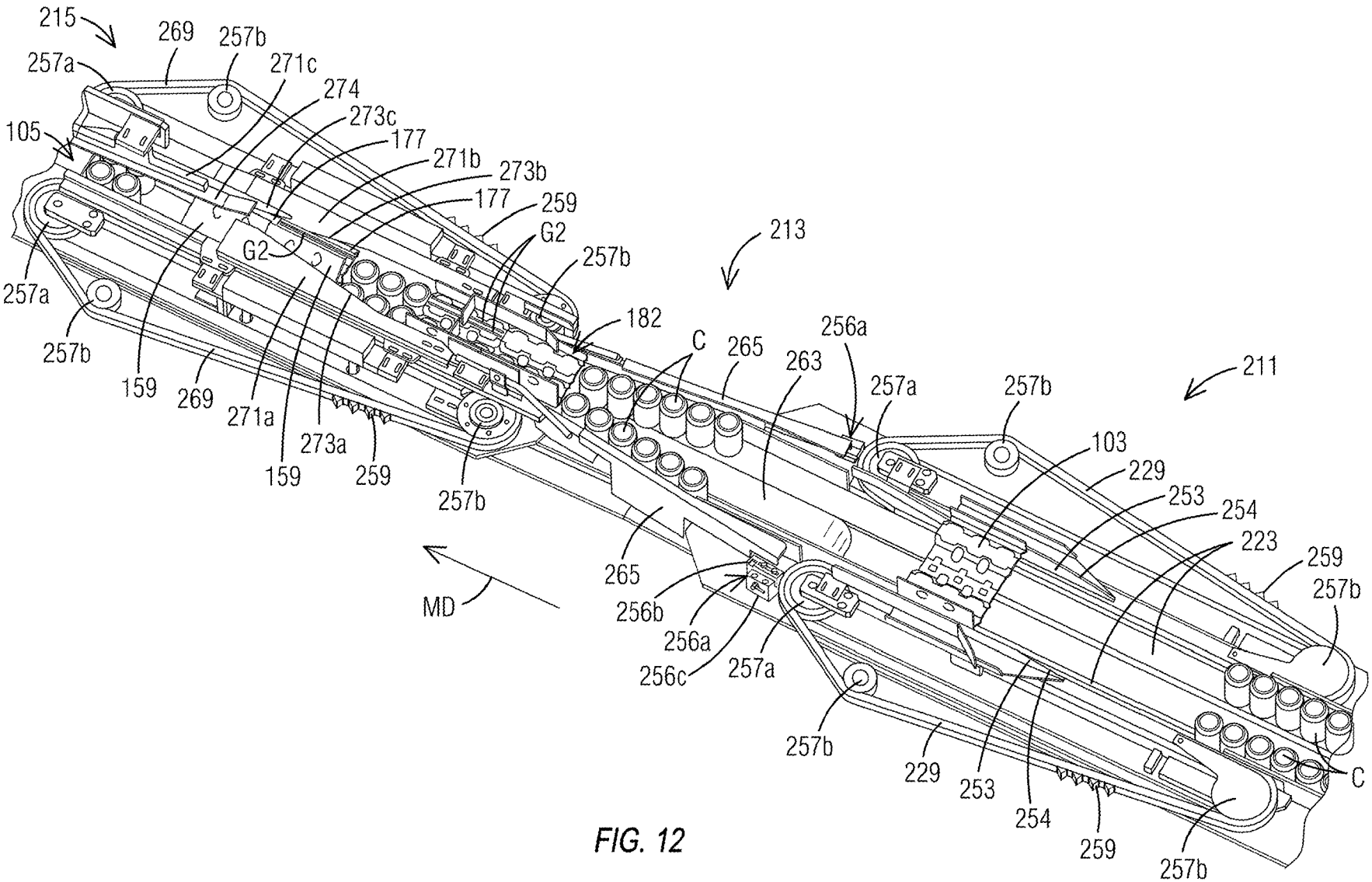
FIG. 12 is a schematic perspective view of the merging station, a folding station, and a portion of the clipping station of the system of FIG. 6.

In the illustrated embodiment, the lug belt 235 and the upstream metering belts 229 can be aligned (e.g., so that the containers C moved by the upstream metering belts 229 are aligned with the clipping features 149*a*, 149*b* in the blanks 103 moved by the lug belt 235) with a lug belt timing preset stop 255*a* (FIG. 7) and metering belt timing preset stops 256*a* (FIGS. 7, 10, and 12). In one embodiment the lug belt timing preset stop 255*a* can include a sliding lock or pin 255*b* that is slidable in a groove in a bracket 255*c*, which is mounted to the frame plate 233. Similarly, the metering belt timing preset stops 256*a* can include a sliding lock or pin 256*b* that is slidable in a groove in a bracket 256*c*. When not in use, the pins 255*b*, 256*b* can be locked in position out of the way of the lug belt 235 and the upstream metering belts 229. When aligning the belts, the lug belt 235 can be moved to align a lug 239 with the pin 255*b* and the pin 255*b* can be advanced to engage the lug 239. Similarly, each of the upstream metering belts 229 can be moved to align a projection 259 with the pin 256*b*, which can be advanced to engage the projection 259. In an exemplary embodiment, the position of the timing preset stops 255*a*, 256*a* can be predetermined so that the lug belt 235 and the upstream metering belts 229 are aligned when the pins 255*b*, 256*b* are engaged with a lug 239 and a projection 259, respectively. After alignment, the pins 255*b*, 256*b* can be locked in the disengaged position for operation of the system 200. The timing preset stops 255*a*, 256*a* could be omitted or could be otherwise arranged, shaped, positioned, or configured without departing from the disclosure.

In the illustrated embodiment, aspects of the system 200 can be adjusted and/or replaced to configure the system 200 for forming packages with containers having different diameters, heights, volumes, etc. For example, the different container diameters can include approximately 53 mm, approximately 58 mm, and approximately 66 mm or the containers can have any suitable diameter. In addition, aspects of the system 200 can be adjusted and/or replaced to configure the system 200 for forming packages with different blanks. For example, the system 200 could be configured to form any of the packages shown and described in the incorporated-by-reference applications listed above. The blanks can be different in size to accommodate the different container sizes and/or in format (e.g., configured for accommodating containers in arrangements such as 2×2, 2×4, 2×6, etc.). In addition, the blanks can have different keel depths, wherein, for example, a carrier may have a deeper keel to accommodate larger and/or heavier containers or a shallower keel for board efficiency. In addition, packages that are to be sold to consumers may have deeper keels for a stronger connection to the containers than packages for only transporting and/or stocking containers for individual sale, for example. In some embodiments, the keel depth can range from approximately 40 mm to approximately 70 mm, for example. Alternatively, the keel can have any suitable depth. The different keel depths can be a result of the size of the central panels (e.g., the central panels 125*a*, 125*b* in the blank 103) in the longitudinal direction L1 so that a deeper keel will result in a blank that is longer in the longitudinal direction L1 and a shallower keel will result in a blank that is shorter in the longitudinal direction L1.

In one embodiment, aspects of the clipping station 211 (as well as other aspects of the system 200) can be adjusted to accommodate the different blanks and containers. For example, the position of the overhead assembly 227 can be adjusted in the vertical direction MV for different container heights. In an exemplary embodiment, the overhead assembly 227 can be mounted to the frame of the system 200 with a motor or other features (not shown) that can move the overhead assembly in the vertical direction MV. In another example, the lug belt 235 can be adjusted or replaced to accommodate different blank widths in the lateral direction L2 (e.g., for different formats and/or different container diameters). In one embodiment, the lugs 239 can be secured to the belt 235 at the necessary spacing for a particular blank and the belt 235 can be selected for length so that every lug 239 is spaced from the next lug by the necessary spacing along the lug belt 235. Several different belt lengths for the lug belt 235 are schematically shown in FIGS. 6 and 7. In one embodiment, when the lug belt 235 is changed for one with a different length, the one or more of the guide wheels 237*b* can be adjusted to apply an appropriate tension to the lug belt 235. In another example, the pressing units 241, the clipping guides 251*a*, 251*b*, 251*c*, the upstream metering belts 229, and/or the initial plows 253 can be adjusted in the transverse direction MT for different container diameters and/or different keel depth. In a further example, the upstream metering belts 229 can be adjusted and/or replaced to accommodate different container diameters. In one embodiment, the spacing between the projections 259 can be adjusted for a particular container diameter and the length of the upstream metering belts 229 can be selected so that all of the projections 259 are appropriately spaced from the respectively adjacent projections 259 along the upstream metering belts 229. Different belt lengths for the upstream metering belts 229 are schematically shown in FIGS. 6 and 7. In one embodiment, when the upstream metering belts 229 are changed for ones having different lengths, one or more of the guide wheels 257*b* can be adjusted to apply an appropriate tension to the upstream metering belts 229. In a further example, the positions of the two lanes or streams of containers C can be adjusted in the transverse direction MT so that the containers C line up with the attachment panels 131*a*, 131*b* of different blanks (e.g., the positions of the containers C can be adjusted on the upstream conveyors 223 and/or the positions of the upstream conveyors 223 can be adjusted). In one embodiment, carriers with different keel depths can have different sized keel portions (e.g., the central panels 125*a*, 125*b*) in the unfolded blank, which may lead to adjustment to the positions of the upstream conveyors 223 and/or other aspects of the system to align the lanes of containers with the attachment panels 131*a*, 131*b*.

Any portion of the clipping station 211 could be omitted or could be otherwise arranged, shaped, positioned, or configured without departing from the disclosure.

Figure 11:
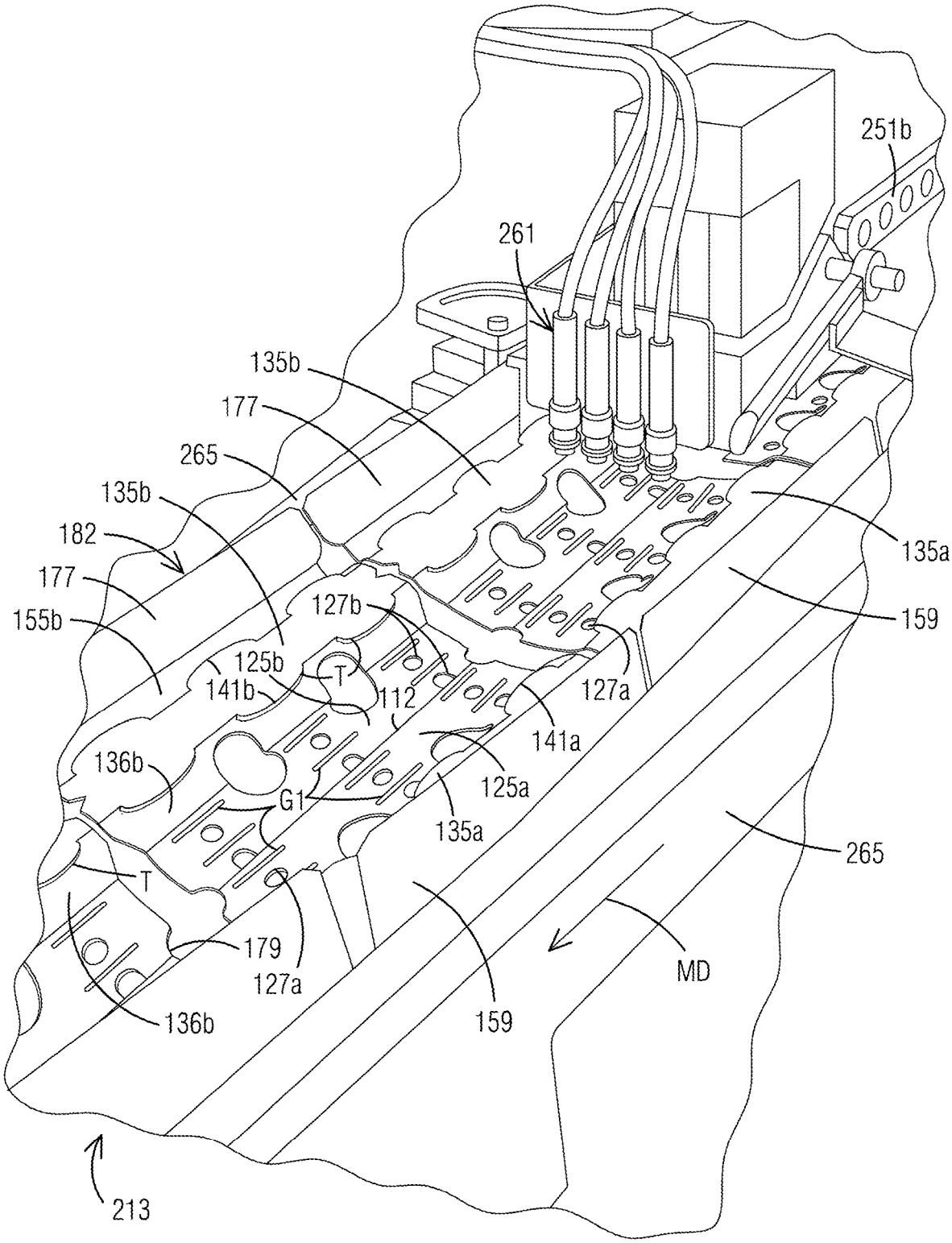
FIG. 11 is a schematic perspective view of a gluing station and a portion of the merging station of FIGS. 6 and 7.

As shown in FIGS. 6, 7, 11, and 12, the clipped assemblies 182 formed in the clipping station 211 pass to the merging station 213. As shown in FIGS. 6-8, 10, and 11, the clipped assemblies 182 can pass a keel gluing unit 261 at a downstream end of the clipping station 211 and an upstream end of the merging station 213. In one embodiment, the keel gluing unit 261 can apply any suitable number of beads of glue G1 (FIG. 11) to the central panels 125*a*, 125*b* of the blank 103 for gluing the central panels 125*a*, 125*b* to the respective containers C via the glue openings 127*a*, 127*b* and/or to one another. Generally, the merging station 213 can guide the containers C in the clipped assemblies 182 toward one another (e.g., toward a centerline of the system 200) while the central panels 125*a*, 125*b* fold downwardly between the containers C to form the keel 180. As shown in FIG. 12, the containers C can be moved from the upstream conveyors 223 to a downstream conveyor 263, a portion of which extends between the upstream conveyors 223. Also as shown in FIGS. 7, 11, and 12, the merging station 213 can include two merging guides 265 that are angled so that they are spaced apart in the transverse direction MT by a larger distance at the upstream end of the merging station 213 than at its downstream end. Accordingly, the merging guides 265 can engage the blanks 103 (e.g., at the side panels 155*a*, 155*b* and/or the top panels 159, 177) and the containers C of the clipped assemblies 182 to gradually urge the containers C together and to urge the containers C from the upstream conveyors 223 to the downstream conveyor 263 as the clipped assemblies 182 are moved in the downstream direction by the conveyors 223, 263.

In one embodiment, the keel gluing unit 261 can be adjusted in the vertical direction MV (e.g., to accommodate different container heights) and/or in the transverse direction MT to apply the glue beads to the central panels 125*a*, 125*b* as needed for different blanks 103. In addition, the merging guides 265 can be adjusted in the transverse direction MT (e.g., in order to accommodate different container diameters and/or keel depths). Any portion of the merging station 213 could be omitted or could be otherwise arranged, shaped, positioned, or configured without departing from the disclosure.

Figure 13:
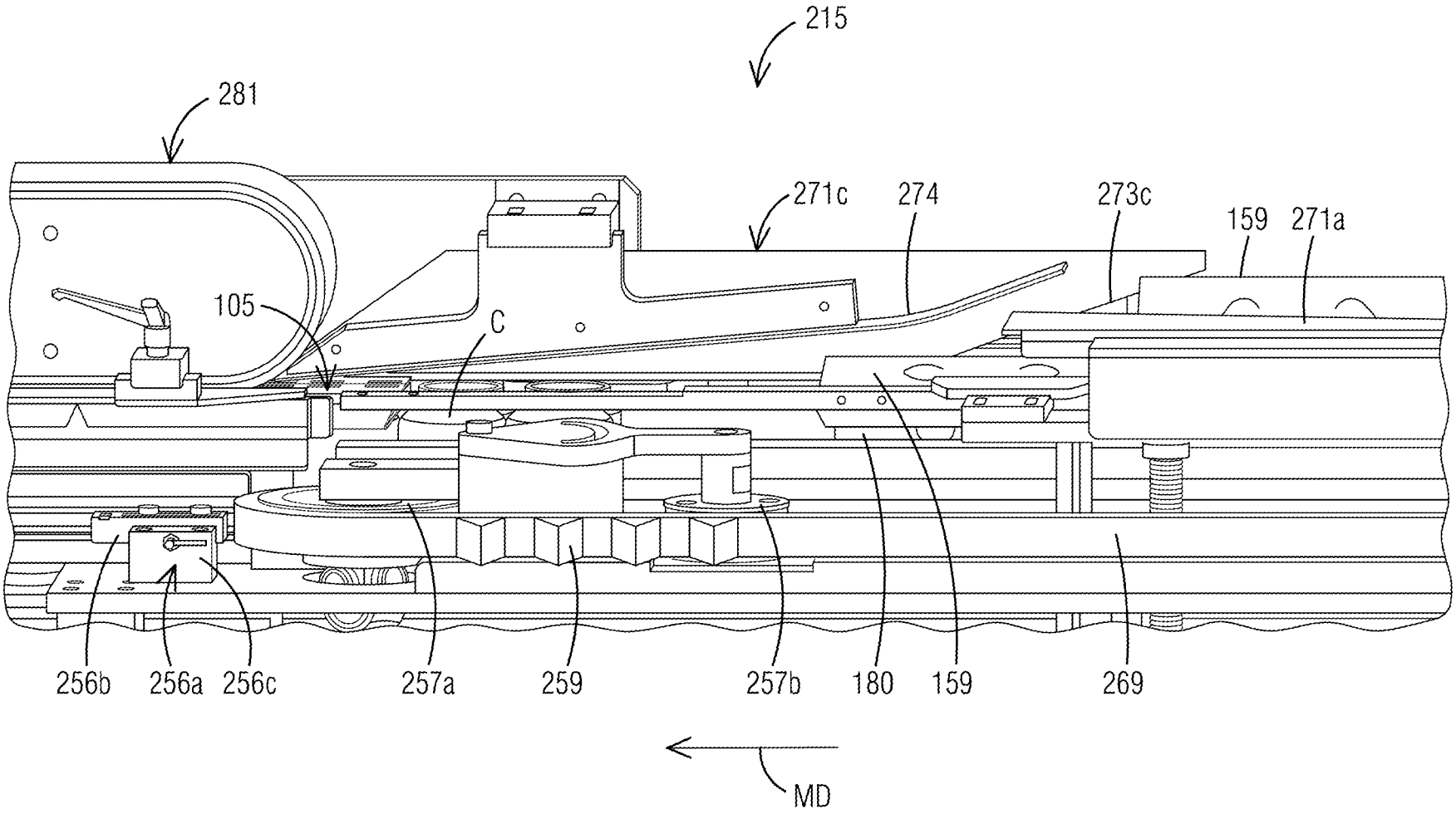
FIGS. 13 and 14 are schematic perspective views of portions of the folding station of FIGS. 6 and 12.
Figure 14:
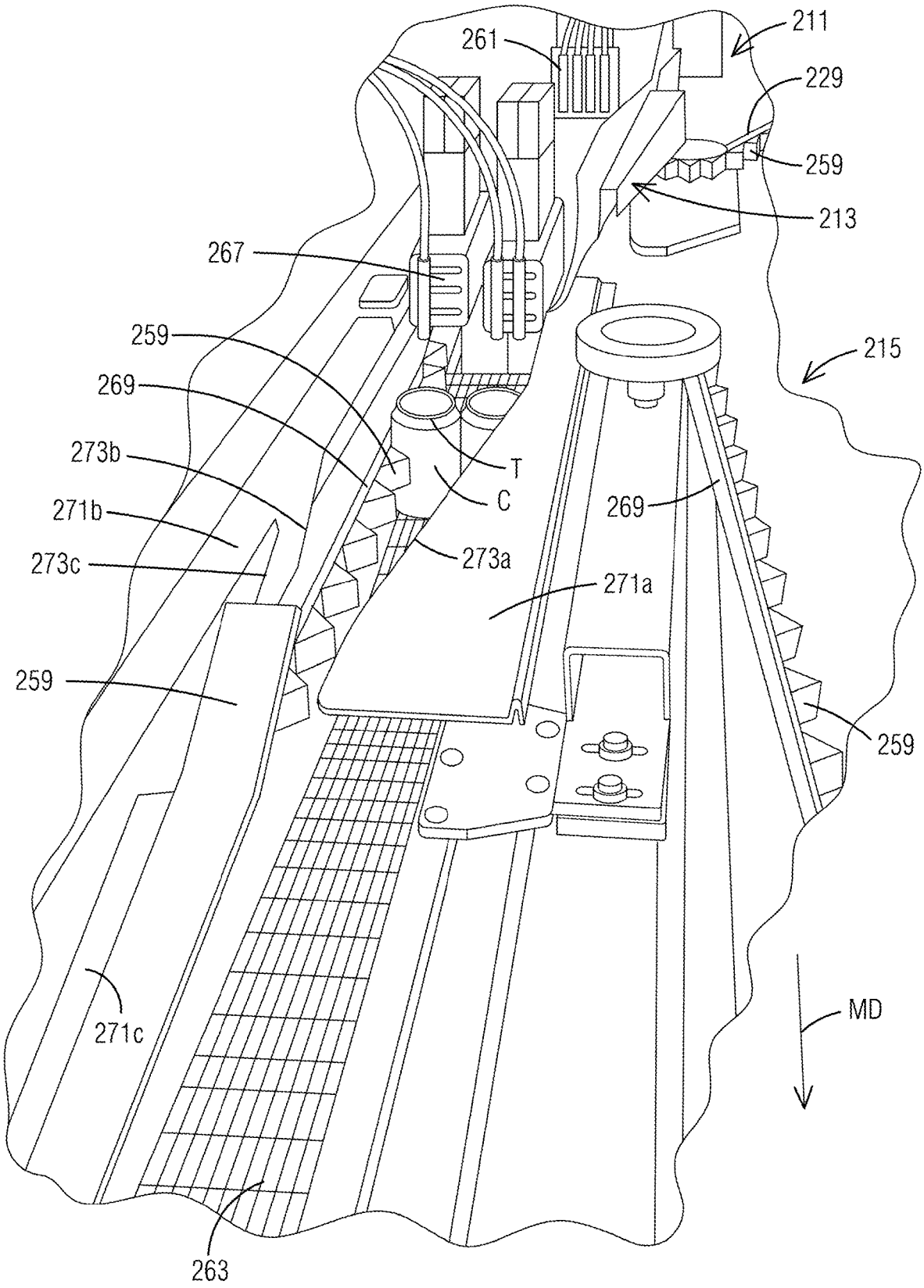

As shown in FIGS. 6 and 12-14, the clipped assemblies 182 with the formed keels 180 can pass from the merging station 213 to the folding station 215. As shown in FIGS. 6, 7, and 14, the clipped assemblies can pass under a crown panel gluing unit 267 at the upstream end of the folding station 215. In one embodiment, the crown panel gluing unit 265 can apply any suitable number of beads of glue G2 (FIGS. 11 and 12) to the container retention portions 135*a*, 135*b* (e.g., the crown panels) of the blanks 103 for gluing the top panels 159, 177 to either or both of the container retention portions 135*a*, 135*b*. Generally, the folding station 215 can further fold the top panels 159, 177 of the blanks 103 onto the container retention portions 135*a*, 135*b*. In the illustrated embodiment, the folding station 215 can include two downstream side transport belts or downstream metering belts 269, a first top plow 271*a*, a second top plow 271*b*, and a downward plow 271*c*. The downstream metering belts 269 can be similar or identical to the upstream metering belts 229 and can help move the containers C of the clipped assemblies 182 in the downstream direction MD through the folding station 215. For example, the downstream metering belts 269 can be mounted on a drive wheel 257*a* and guide wheels 257*b* and can include a timing preset stop 256*a* (FIG. 13), which can be similar or identical to the timing preset stop 256*a* associated with the upstream metering belts 229 and can be configured for setting up the downstream metering belts 269 in concert with the lug belt 235 and the upstream metering belts 229. Similarly to the upstream metering belts 229, the downstream metering belts 269 can include projections 259 (FIGS. 6 and 12-14, schematically showing some of the projections 259 along a portion of the length of the belts 269). In one embodiment, the downstream metering belts 269 can apply a compression force (e.g., the transverse direction MT) on the containers C in at least a portion of the folding station 215 to help bond the containers C to the respective central panels 125*a*, 125*b* with the glue beads G1.

As shown in FIGS. 12-14, the top plows 271*a*, 271*b* can include a horizontal (e.g., generally or substantially horizontal) plate extending at least partially over the downstream conveyor 263. The top plows 271*a*, 271*b* can include respective angled edges 273*a*, 273*b* that engage the respective top panels 159, 177 of the blanks 103 to fold the top panels 159, 177 (e.g., along the lateral fold lines 161*a*, 161*b*) over the crown panels 135*a*, 135*b* as the clipped assemblies 182 are moved in the downstream direction MD by the downstream metering belts 269 and the downstream conveyor 263. In the illustrated embodiment, the angled edge 273*a* is longer than the angled edge 273*b* and the downstream end of the first top plow 271*a* extends farther over the downstream conveyor 261 than the downstream end of the second top plow 271*b* because the top panel 159 is larger (e.g., in the longitudinal direction L1) than the top panel 177. In other embodiments, the top plows 271*a*, 271*b* could be alternatively configured for blanks with different top panel configurations.

In the illustrated embodiment, the downward plow 271*c* can be spaced at least partially downstream from the top plows 271*a*, 271*b*. As shown in FIGS. 12-14, the downward plow 271*c* can have a sloped upstream edge 273*c* and a sloped surface 274 (FIG. 13) for engaging the respective top panels 177, 159 and gradually pressing the respective top panels 177, 159 down against the crown panels 135*b*, 135*a* with the glue beads G2 therebetween to secure the top panels 177, 159 in position in the now-closed carrier 105 as the downstream conveyor 263 and the downstream metering belts 269 move the containers C and the attached carrier 105 in the machine direction MD.

In one embodiment, the plows 271*a*, 271*b*, 271*c* can be adjusted in the vertical direction MV and the transverse direction MT (e.g., to accommodate containers C with different heights and diameters). In addition, the downstream metering belts 269 can be adjusted in a similar or identical manner as the upstream metering belts 229. Since the keel 180 has been formed prior to the clipped assemblies 182 moving into the folding station 215, the depth of the keel 180 (and the size of the central panels 125*a*, 125*b* in the longitudinal direction L1) can have little or no impact on the adjustments to the plows 271*a*, 271*b*, 271*c* and/or the downstream metering belts 269. Any portion of the folding station 215 could be omitted or could be otherwise arranged, shaped, positioned, or configured without departing from the disclosure.

As shown in FIGS. 6 and 13, the system 200 can include a compression belt 281 positioned over the downstream conveyor 263 downstream from the folding station 215. In the illustrated embodiment, the compression belt 281 can be driven over wheels so that the bottom length of the belt moves in the downstream direction MD in contact with the top panels 159, 177 of the carrier 105 as the packages 110 are moved in the downstream direction MD on the downstream conveyor 263. In one embodiment, the compression belt 281 can press downwardly on the top panels 159, 177 of the carriers 105 (e.g., against the support of the downstream conveyor 263) to facilitate bonding of the top panels 159, 177 to the crown panels 135*a*, 135*b*. In the illustrated embodiment, the compression belt 281 can be adjusted in the vertical direction MV in order to accommodate containers C with different heights, for example. The compression belt 281 could be omitted or could be otherwise arranged, shaped, positioned, or configured without departing from the disclosure.

In an exemplary embodiment, the formed packages 110 can move downstream on the downstream conveyor 263 from the compression belt 281 for further processing (e.g., positioning the packages 110, loading the packages into cartons, etc.) and/or for storage and/or shipping. The system 200 could be otherwise configured without departing from the disclosure. For example, in one embodiment, the upstream conveyors 223 and/or the downstream conveyor 263 could be replaced by a single, wider conveyor extending along the system 200.

Figure 15:
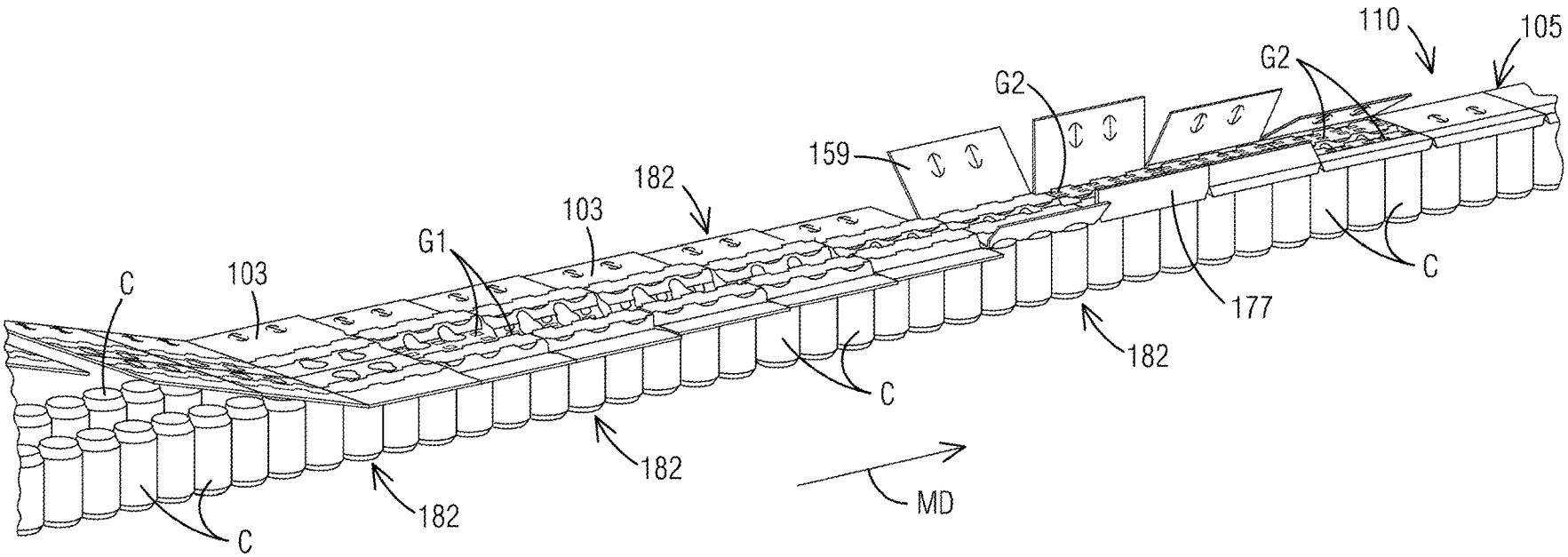
FIG. 15 is a schematic perspective view of a product flow showing the formation of the clipped assembly of FIGS. 2 and 3 and the package of FIG. 5 according to an exemplary embodiment of the disclosure.

In operation, in an exemplary embodiment, a package 110 can be formed in the system 200 (e.g., as schematically shown in the product flow of FIG. 15). For example, a blank 103 can be fed to the support plate 225 and can slide down the support plate 225 to the clipping station 211 (FIGS. 7-10). In one exemplary embodiment, the blank 103 can be moved along at least a portion of the support plate 225 by one or more belts or other conveyors mounted along at least a portion of the support plate 225. A leading edge (e.g., the downstream edge) of the blank 103 can engage the lug belt 235 so that one of the lugs 239 engages a lug notch 179 in the leading edge of the blank 103. As the blank 103 continues to move on the support plate 225, the lug belt 235 can engage the blank and help move the blank in the downstream direction MD. A subsequent lug 239 on the lug belt 235 can engage the lug notch 179 in the trailing (e.g., upstream) edge of the blank 103 and the lug belt 235 and the lugs 239 can move the blank 103 in the downstream direction MD at the same speed as the containers C are moved on the upstream conveyors 223 in the first and second streams/lanes. In some embodiments, the blanks do not include lug notches and the lugs 239 can engage the leading and/or trailing edges of the blanks. In one embodiment, the lugs 239 are arranged on the lug belt 235 so that the clipping features 149*a*, 149*b* of the blank 103 are aligned with tops T of the containers C when the containers C are engaged between respective projections 259 in the upstream metering belts 229. As shown in FIG. 7, the lug belt 235 can move the blank 103 past the downstream end of the support plate 225 so that the container retention portions (crown panels) 135*a*, 135*b* rest on the tops T of the containers C and the guide belts 243 engage the blank 103 (FIG. 9). The guide belts 243 and the guide bars 247 can press downwardly on the crown panels 135*a*, 135*b* and the containers C located under the blank 103 to help retain the blank 103 in contact with the containers C and to help prevent the containers C from rotating as the guide belts 243, the blanks 103, and the containers C move in the downstream direction MD. As shown in FIGS. 7, 9, and 10, the top panels 159, 177, the side panels 155*a*, 155*b*, and/or the exterior marginal portions 138*a*, 138*b* of the blank 103 can engage the outer clipping guides 251*a* as the blank 103 and the containers C are moved in the downstream direction MD by at least the respective lug belt 235 and upstream metering belts 229 and the sloped upstream end 252 of the outer clipping guides 251*a* can press the outer portions of the blank 103 downwardly relative to the remainder of the blank 103.

As shown in at least FIGS. 9 and 10, the inner clipping guides 251*b* can engage the interior marginal portions 136*a*, 136*b* and/or the central panels 125*a*, 125*b* of the blank 103 to provide tension on the inner portion of the blank 103 as the outer clipping guides 251*a* engage the top panels 159, 177, the side panels 155*a*, 155*b*, and/or the exterior marginal portions 138*a*, 138*b* of the blanks 103 to fold the exterior marginal portions 138*a*, 138*b* downwardly with respect to the crown panels 135*a*, 135*b* and form retention edges in the exterior marginal portions 138*a*, 138*b* at the cuts 141*a*, 141*b*. The downward pressure of outer clipping guides 251*a* on the blanks can cause (e.g., force) the retention edges in the exterior marginal portions 138*a*, 138*b* to engage under the chimes of the containers C. Subsequently, the tension guides 251*c* can engage the outer portions of the blank 103 The inner clipping guides 251*b* can gradually press the interior marginal portions 136*a*, 136*b* and/or the central panels 125*a*, 125*b* of the blank downwardly relative to the crown panels 135*a*, 135*b* while the outer clipping guides 251*a* and, subsequently, the tension guides 251*c* engage (e.g., press downwardly on) the outer portions of the blank to help retain the exterior marginal portions 138*a*, 138*b* in engagement with the chimes of the containers. Accordingly, the retention edges can be formed in the interior marginal portions 136*a*, 136*b* at the cuts 141*a*, 141*b* and can be forced to engage under the chimes of the containers C by the inner clipping guides 251*b*. In one embodiment, with the retention edges in the marginal portions 136*a*, 138*a*, 136*b*, 138*b* engaging the chimes of the containers C, the blank 103 is clipped (e.g., attached or mounted) to the containers C to form the clipped assembly 182 (FIGS. 2 and 9-11). The upstream metering belts 229, the upstream conveyors 223, and the lug belt 235 can continue to move the clipped assembly 182 in the downstream direction MD.

As shown in FIGS. 7, 9, and 10, as the blank 103 moves in the downstream direction MD, the top panels 159, 177 and/or the side panels 155*a*, 155*b* can engage the initial plows 253 and be folded upwardly to a vertical (e.g., generally or substantially vertical) orientation. Subsequently, as shown in at least FIGS. 7, 10, and 11, the clipped assembly 182 can pass under the keel gluing unit 261, which can apply beads of glue G1 to the central panels 125*a*, 125*b* so that the bead(s) of glue G1 on the central panel 125*a* are aligned with the respective glue opening(s) 127*b* in the central panel 125*b* when the keel 180 is formed in the merging station 213 and the beads of glue G1 on the central panel 125*b* are aligned with the respective glue opening(s) 127*a* in the central panel 125*a* when the keel 180 is formed.

As shown in FIGS. 7 and 12, the clipped assembly 182 can move on the upstream conveyors 223 through the merging station 213, in which the merging guides 265 can gradually urge the containers C inwardly from the upstream conveyors 223 to the downstream conveyor 263 therebetween while the conveyors 223, 263 move the containers C in the downstream direction MD. As the containers C move toward one another, the central panels 125*a*, 125*b* can fold downwardly between the containers C and into face-to-face contact with one another to form the keel 180 (e.g., FIGS. 7 and 12). The beads of glue G1 on the central panel 125*a* can engage the containers C that are clipped to the attachment panel 131*b* via the glue openings 127*b* in the central panel 125*b* and the beads of glue G1 on the central panel 125*b* can engage the containers C that are clipped to the attachment panel 131*a* via the glue openings 127*a* in the central panel 125*a* in the formed keel 180 (e.g., as discussed above with respect to FIG. 4). In some embodiments, the beads of glue G1 can also bond the central panels 125*a*, 125*b* together.

As the clipped assembly 182 with the formed keel 180 moves in the downstream direction MD on the downstream conveyor 263 from the merging station 213 to the folding station 215, the crown panel gluing unit 267 can apply beads of glue G2 (e.g., as shown in FIGS. 7, 12, and 14) to the crown panels 135*a*, 135*b*. As the clipped assembly 182 moves into the folding station 215, the downstream metering belts 269 can engage the containers C (e.g., with each of the containers engaged between two projections 259) and press the containers C together (e.g., in the transverse direction MT) to move the clipped assembly 182 in the downstream direction MD and to facilitate bonding of the containers C with the central panels 125*a*, 125*b* with the beads of glue G1. As shown in FIGS. 12-14, the top plows 271*a*, 271*b* can fold the top panels 159, 177 over the crown panels 135*a*, 135*b* as the clipped assembly 182 moves in the downstream direction MD. Subsequently, the downward plow 271*c* can press the top panels 159, 177 downwardly onto the crown panels 135*a*, 135*b*. For example, the sloped edge 273*c* of the downward plow 271*c* can press the top panel 177 against a portion of the crown panel 135*b* and then the sloped surface 174 can press downwardly on the top panel 159 against the crown panels 135*a*, 135*b*. The compression belt 281 further can press downwardly on the top panels 159, 177 to facilitate bonding of the top panels 159, 177 to the crown panels 135*a*, 135*b* via the beads of glue G2. In one embodiment, with the top panels 159, 177 secured to the crown panels 135*a*, 135*b*, the folding station 215 can be considered to have formed triangles at the outer portions of the carrier as viewed from the ends of the carrier 105. For example, the triangles can include the respective exterior marginal portions 138*a*, 138*b*, the respective side panels 155*a*, 155*b*, and the respective top panels 159, 177. In an exemplary embodiment, the triangles can help support clipped engagement between the carrier 105 and the containers C.

Accordingly, the top panels 159, 177 are bonded to the crown panels 135*a*, 135*b* to form the carrier 105 with the containers C clipped to the attachment panels 131*a*, 131*b* and bonded to the keel 180 to form the package 110, which is moved to the downstream end 205 of the system 200 for further processing, storage, shipping, etc. The package 110 could be otherwise formed in the system 200 without departing from the disclosure.

While the system 200 has been described in relation to forming the package 110 with the carrier 105 from the blank 103, other blanks can be fed to the system for forming other carriers. For example, a carrier without top panels 159, 177 and/or side panels 155*a*, 155*b* (e.g., the carrier shown and described in the incorporated-by-reference U.S. patent application Ser. No. 16/426,066) can be formed in the system 200 and the crown panel gluing unit 267, the plows 253, 271*a*, 271*b*, 271*c*, and/or the compression belt 281 could be removed or otherwise deactivated.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of at least partially forming packages, the method comprising:

moving a blank and a plurality of articles in a downstream direction through a clipping station, the blank comprising at least a first attachment panel, a second attachment panel, and a keel portion extending from the first attachment panel to the second attachment panel;

forming a clipped assembly by clipping the first attachment panel and the second attachment panel of the blank to respective articles of the plurality of articles during the moving the blank and the plurality of articles in the downstream direction through the clipping station;

forming a keel by moving articles of the plurality of articles toward one another and folding the keel portion of the blank between the articles as the clipped assembly is moved in the downstream direction; and attaching the respective articles of the plurality of articles to the keel by adhering the keel to the respective articles.

2. The method of claim 1, wherein the blank comprises a plurality of openings extending in the keel portion, and the attaching the respective articles to the keel comprises applying beads of glue to areas of the keel portion so that at least a portion of each bead of glue adheres a respective article to the keel via a respective opening of the plurality of openings.

3. The method of claim 1, wherein the attaching the respective articles of the plurality of articles to the keel comprises applying beads of glue to the keel portion so that the beads of glue adhere at least a portion of the keel to the respective articles during the forming the keel.

4. The method of claim 3, wherein the forming the keel further comprises compressing the clipped assembly in a transverse direction with respect to the downstream direction after the folding the keel portion between the articles to press the keel between the articles to facilitate adhering the articles to the keel with the beads of glue.

5. The method of claim 1, wherein the clipping station comprises two outer clipping guides and two inner clipping guides, each having a sloped surface, and the clipping the first attachment panel and the second attachment panel to the respective articles comprises moving respective outer portions of the blank downwardly under the sloped surfaces of the two outer clipping guides and moving respective inner portions of the blank downwardly under the sloped surfaces of the two inner clipping guides during the moving the blank and the plurality of articles in the downstream direction through the clipping station.

6. The method of claim 5, wherein each of the first attachment panel and the second attachment panel comprises a respective interior marginal portion and a respective exterior marginal portion, the moving the outer portions of the blank downwardly causing the exterior marginal portions to fold downwardly and engage under respective chimes of the containers, and the moving the inner portions of the blank downwardly causing the interior marginal portions to engage under respective chimes of the containers.

7. The method of claim 5, wherein the two inner clipping guides are positioned at least partially downstream from the two outer clipping guides.

8. The method of claim 5, wherein the clipping station further comprises two tension guides positioned at least partially downstream from the two outer clipping guides, the two tension guides contacting the outer portions of the blank during at least a portion of the moving the inner portions of the blank downwardly.

9. The method of claim 1, wherein the moving the blank and the plurality of articles in the downstream direction through the clipping station comprises moving the plurality of articles in a first stream and a second stream on at least one upstream conveyor and moving the blank with a lug belt.

10. The method of claim 9, wherein the lug belt is positioned at least partially above the blank and comprises a lug pushing the blank in the downstream direction.

11. The method of claim 1, wherein the clipping station comprises a plurality of guide belts positioned above the blank, each guide belt of the plurality of guide belts pressing downwardly on the respective first attachment panel and second attachment panel during the moving the blank and the plurality of articles in the downstream direction through the clipping station.

12. The method of claim 1, wherein the moving the blank and the plurality of articles in the downstream direction through the clipping station comprises moving the plurality of articles in a first stream and a second stream, and the forming the keel comprises urging the articles in the first stream and the second stream toward one another with respective merging guides while allowing the keel portion of the blank to fold downwardly between the articles in the first stream and the second stream while moving the clipped assembly in the downstream direction.

13. The method of claim 12, wherein the moving the articles in the first stream and the second stream comprises moving the articles in the first stream and the second stream on a respective first upstream conveyor and second upstream conveyor, and the urging the articles in the first stream and the second stream toward one another comprises moving the articles from the first upstream conveyor and the second upstream conveyor to a downstream conveyor.

14. The method of claim 1, wherein the keel portion comprises a first central panel and a second central panel and the folding the keel portion comprises folding the first central panel and the second central panel relative to one another.

15. The method of claim 14, wherein the forming the keel further comprises bringing the first central panel and the second central panel at least partially into face-to-face contact with one another.

16. The method of claim 14, wherein the first attachment panel comprises a first interior marginal portion, the second attachment panel comprises a second interior marginal portion, the first central panel is foldably connected to the first interior marginal portion, the second central panel is foldably connected to the second interior marginal portion.

17. The method of claim 16, wherein the clipping the first attachment panel and the second attachment panel to the respective articles comprises engaging one or more retention edges of the first interior marginal portion and one or more retention edges of the second interior marginal portion with the respective articles, and wherein the first central panel and the second central panel are spaced apart from the one or more retention edges in the first interior marginal portion and the one or more retention edges of the second interior marginal portion.

18. The method of claim 14, wherein the first central panel is foldably connected to the first attachment panel and the second central panel is foldably connected to the second attachment panel, and wherein the attaching the respective articles to the keel comprises adhering the first central panel to one or more articles clipped to the second article attachment panel and adhering the second central panel to one or more articles clipped to the first article attachment panel.

19. A method of at least partially forming packages, the method comprising:

moving a blank and a plurality of articles in a downstream direction through a clipping station, the blank comprising at least a first attachment panel, a second attachment panel, and a keel portion extending from the first attachment panel to the second attachment panel, wherein the first attachment panel comprises at least a first crown panel and a first interior marginal portion extending from the first crown panel, the second attachment panel comprises at least a second crown panel and a second interior marginal portion extending from the second crown panel, and the keel portion comprises at least a first central panel foldably connected to the first interior marginal portion and a second central panel foldably connected to the second interior marginal portion;

forming a clipped assembly by clipping the first attachment panel and the second attachment panel of the blank to respective articles of the plurality of articles during the moving the blank and the plurality of articles in the downstream direction through the clipping station, the clipping the first attachment panel and the second attachment panel to the respective articles comprising folding at least the first interior marginal portion and the second interior marginal portion with respect to the first crown panel and the second crown panel;

forming a keel by moving articles of the plurality of articles toward one another and folding the keel portion of the blank between the articles as the clipped assembly is moved in the downstream direction; and adhering the first central panel to one or more articles clipped to the second article attachment panel and adhering the second central panel to one or more articles clipped to the first article attachment panel.

20. The method of claim 19, wherein the clipping the first attachment panel and the second attachment panel to the respective articles comprises folding the first interior marginal portion and the second interior marginal portion downwardly with respect to the first crown panel and the second crown panel and engaging one or more retention edges of the first interior marginal portion and one or more retention edges of the second interior marginal portion with the respective articles.

* * * * *